US011400616B2

(12) United States Patent
Asai

(10) Patent No.: US 11,400,616 B2
(45) Date of Patent: Aug. 2, 2022

(54) COUNTERPLATE POSITIONING JIG

(71) Applicant: Kazuaki Asai, Kanazawa (JP)

(72) Inventor: Kazuaki Asai, Kanazawa (JP)

(73) Assignee: Kazuaki Asai, Kanazawa (JP)

( * ) Notice: Subject to any disclaimer, the term of this patent is extended or adjusted under 35 U.S.C. 154(b) by 416 days.

(21) Appl. No.: 16/085,359

(22) PCT Filed: May 9, 2016

(86) PCT No.: PCT/JP2016/063747
§ 371 (c)(1),
(2) Date: Sep. 14, 2018

(87) PCT Pub. No.: WO2016/143916
PCT Pub. Date: Sep. 15, 2016

(65) Prior Publication Data

US 2019/0084176 A1 Mar. 21, 2019

Related U.S. Application Data

(63) Continuation-in-part of application No. PCT/JP2016/058578, filed on Mar. 17, 2016.

(30) Foreign Application Priority Data

Mar. 9, 2015 (JP) ..... 2015-045570
Mar. 17, 2016 (JP) ..... PCT/JP2016/058578

(51) Int. Cl.
*B26F 1/44* (2006.01)
*B26F 1/40* (2006.01)
(Continued)

(52) U.S. Cl.
CPC ..... *B26F 1/40* (2013.01); *B26D 7/2614* (2013.01); *B26F 1/00* (2013.01); *B26F 1/44* (2013.01); *B26F 2001/4463* (2013.01)

(58) Field of Classification Search
CPC ..... B26F 1/40; B26F 1/44; B26F 1/00; B26D 7/2614
(Continued)

(56) References Cited

U.S. PATENT DOCUMENTS 4,004,448 A * 1/1977 von Holdt ..... B21D 37/10 72/462
4,341,008 A 7/1982 Graboyes et al.
4,397,095 A * 8/1983 Graboyes ..... B26D 7/2614 33/627

FOREIGN PATENT DOCUMENTS

DE 102009052823 A1 5/2011
GB 1427464 A 3/1976
(Continued)

OTHER PUBLICATIONS

International Search Report dated Nov. 12, 2017, 2 pages.
Great Britain Search Report dated Jan. 20, 2017, 4 pages.

*Primary Examiner* — Chelsea E Stinson
*Assistant Examiner* — Mary C Hibbert-Copeland
(74) *Attorney, Agent, or Firm* — Manabu Kanesaka

(57) ABSTRACT

[Problem] To make it easy to attach a counterplate to a specified position on a cutting plate, to prevent the counterplate falling from the cutting die during blanking, and to prevent the counterplate from making contact with a sheet. [Solution] The present invention includes: a housing (2) which includes a hole-side inclined portion (21), and in which an accommodation hole is formed; an engaging means (3) which alternates between a lower lock and an upper lock in the housing (2); and a sliding shaft member (4) fitted in the housing. The inside diameter of the upper side of the hole-side inclined portion (21) is larger than the inside diameter of the lower side thereof. The engaging means (3) is disposed above the hole-side inclined portion (21). In the sliding shaft member (4), the following are integrally
(Continued)

formed: a lower-side inclined portion (42) which is disposed above a protruding part that protrudes below the housing (2), and which has the same direction of inclination as the hole-side inclined portion (21) and a different angle of inclination thereto; and a middle inclined portion (43) which is disposed above the lower-side inclined portion (42), and which has the opposite direction of inclination to the hole-side inclined portion (21). When the sliding shaft member (4) is pulled downwards and is stopped at the lower limit position, the lower lock state is engaged, and when the sliding shaft member (4) is pushed upwards and is stopped at the upper limit position, the upper lock state is engaged.

19 Claims, 18 Drawing Sheets

(51) Int. Cl.
*B26F 1/00* (2006.01)
*B26D 7/26* (2006.01)

(58) Field of Classification Search
USPC ..... 493/468
See application file for complete search history.

(56) References Cited

FOREIGN PATENT DOCUMENTS

| | | | |
|---|---|---|---|
| JP | 2005-313270 | A | 11/2005 |
| WO | 2007/043125 | A1 | 4/2007 |

* cited by examiner

[FIG. 1]
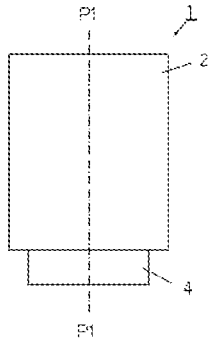
[FIG. 2]
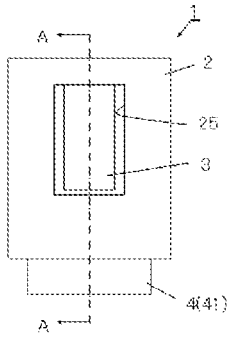
[FIG. 3]
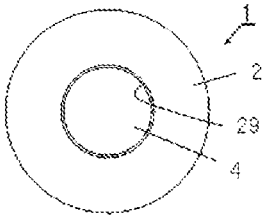
[FIG. 4]
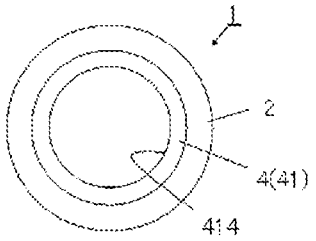

[FIG. 5]
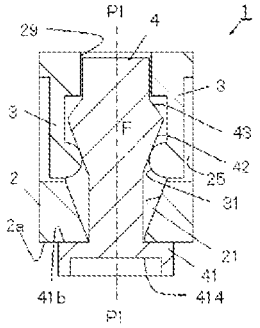
[FIG. 6]
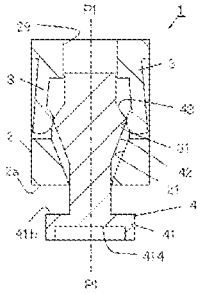
[FIG. 7]
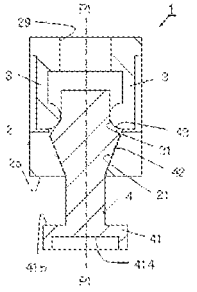
[FIG. 8]
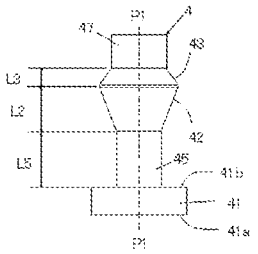

[FIG. 9]
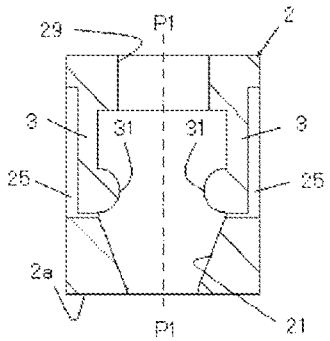
[FIG. 10]
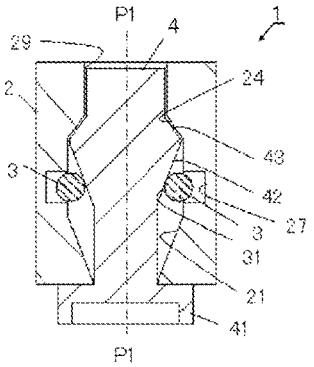
[FIG. 11]
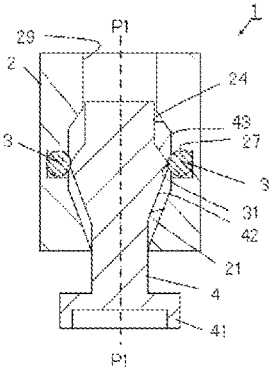
[FIG. 12]
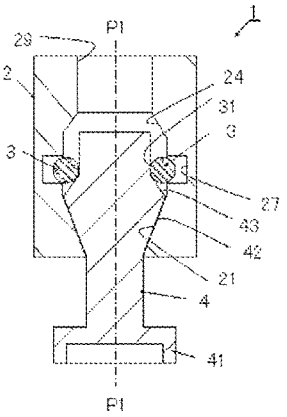

[FIG. 13]
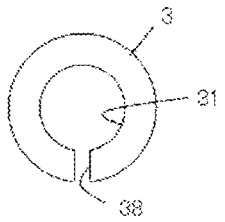
[FIG. 14]
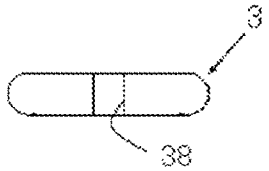
[FIG. 15]
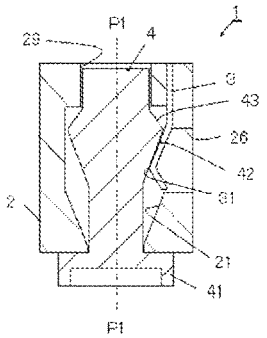
[FIG. 16]
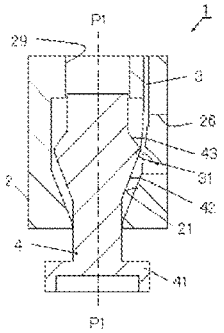
[FIG. 17]
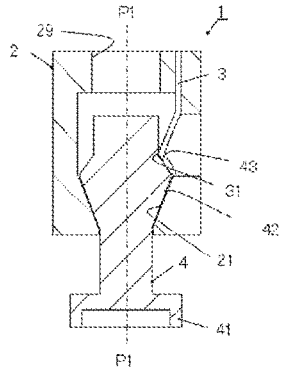

[FIG. 18]
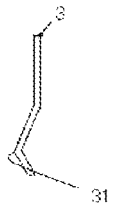
[FIG. 19]
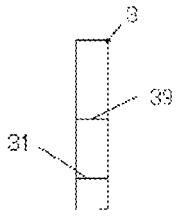
[FIG. 20]
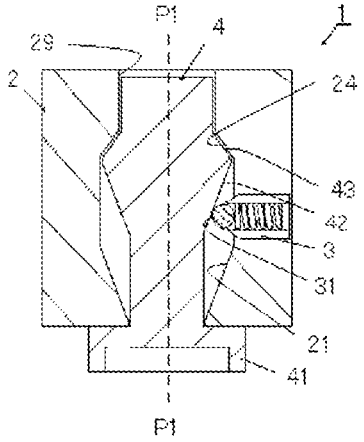
[FIG. 21]
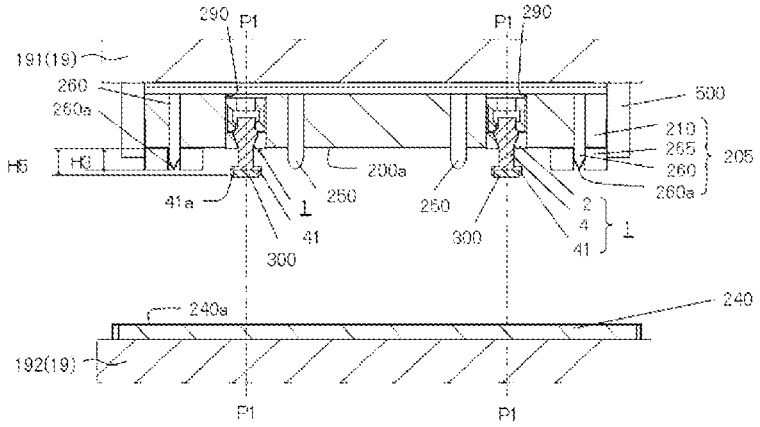

[FIG. 22]
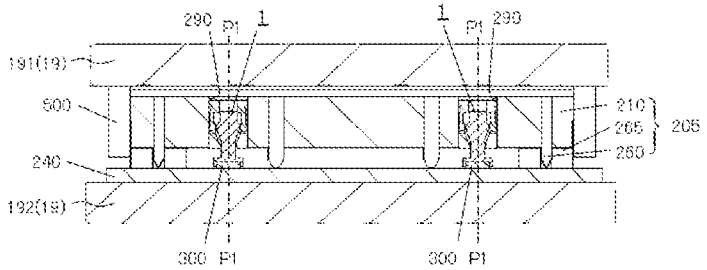
[FIG. 23]
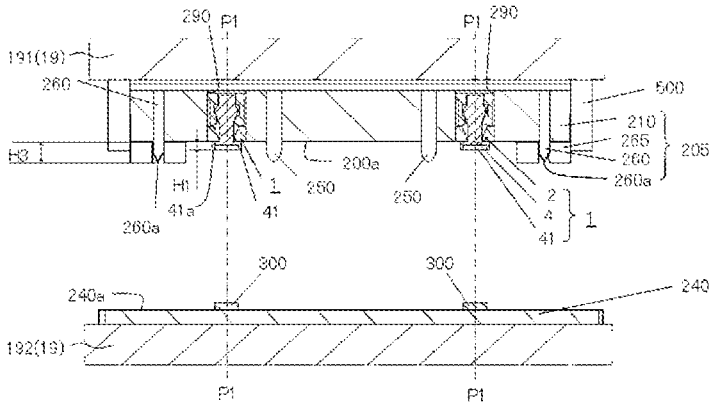
[FIG. 24]
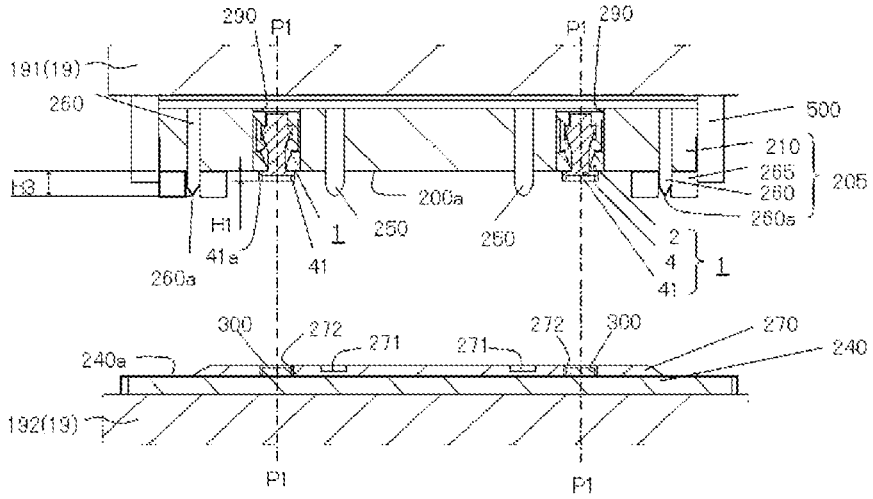

[FIG. 25]
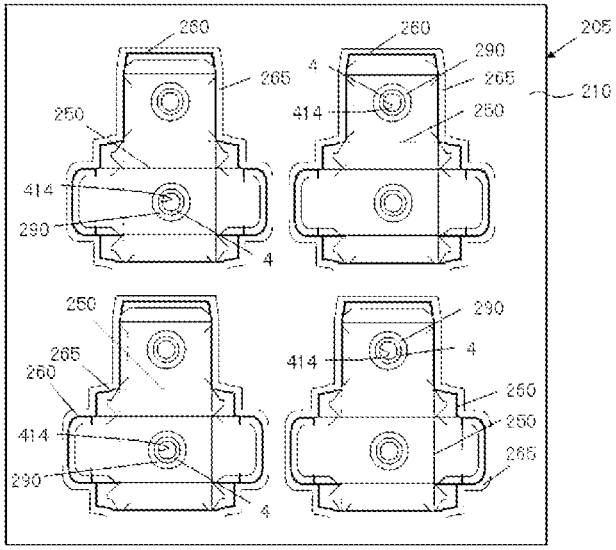
[FIG. 26]
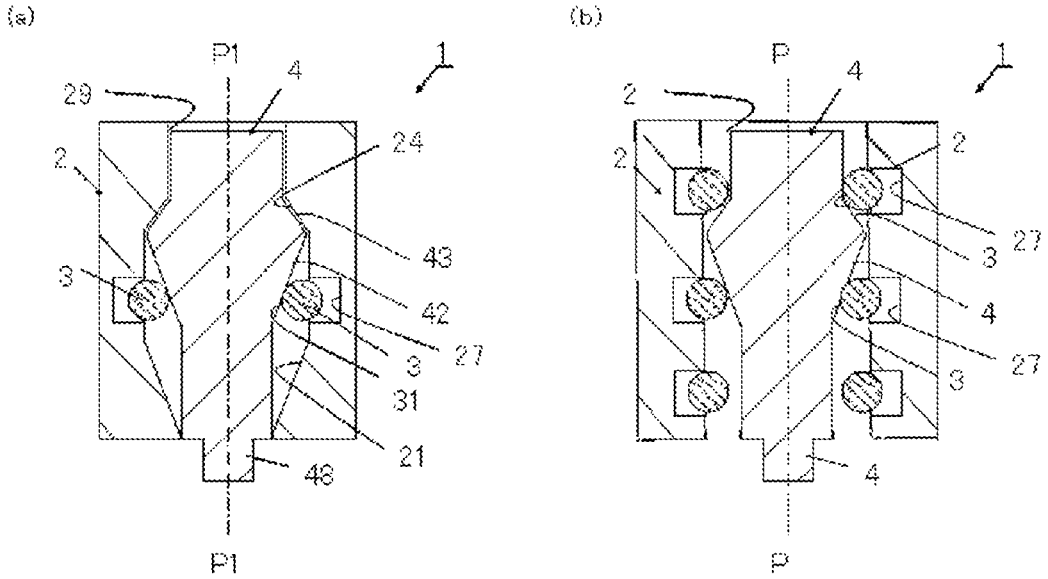
[FIG. 27]
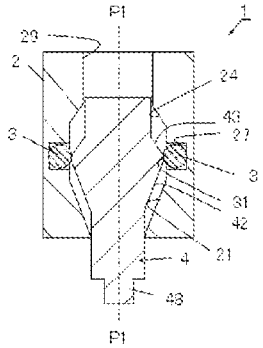

[FIG. 28]
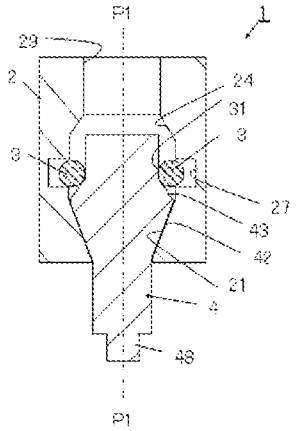
[FIG. 29]
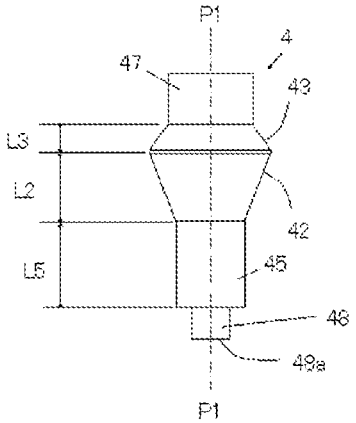
[FIG. 30]
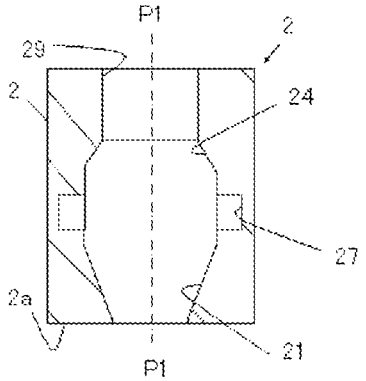

[FIG. 31]
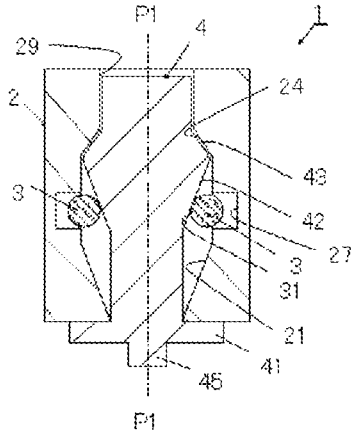
[FIG. 32]
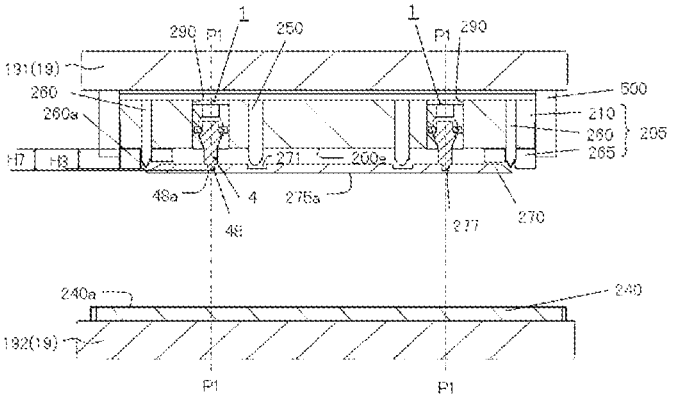
[FIG. 33]
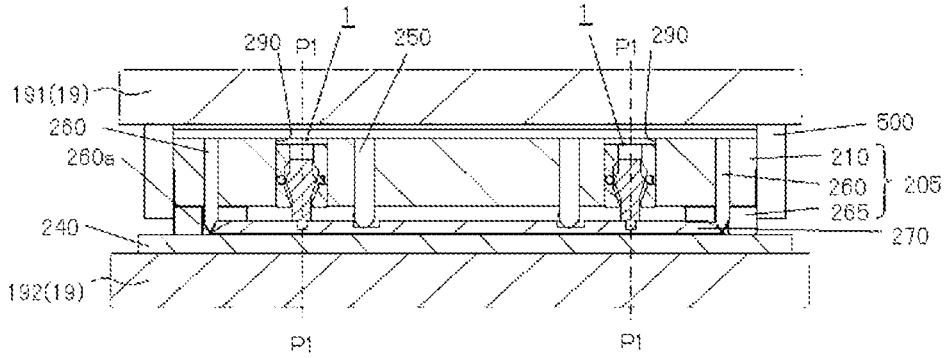

[FIG. 34]
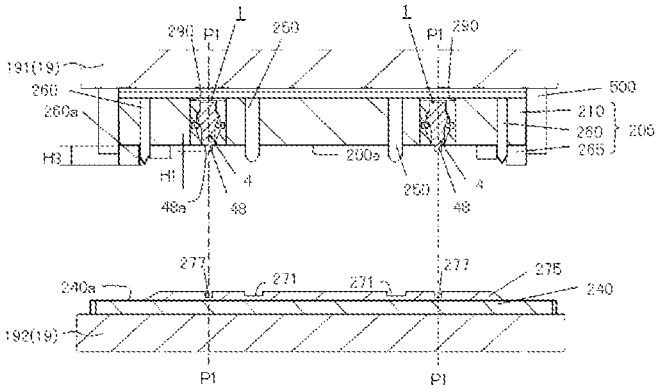
[FIG. 35]
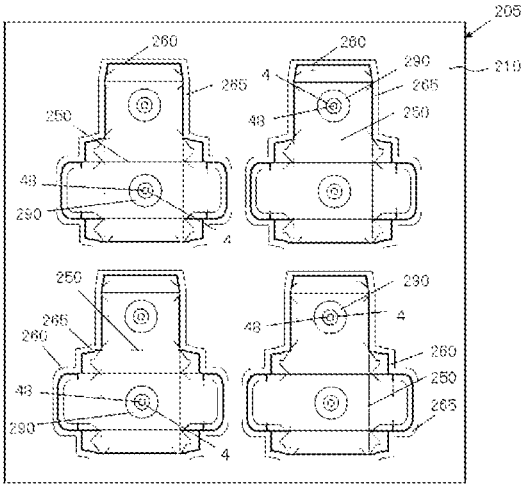
[FIG. 36]
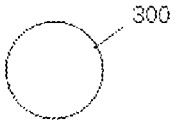
[FIG. 37]
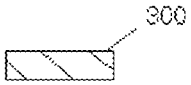
[FIG. 38]
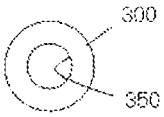
[FIG. 39]
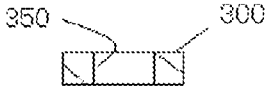

[FIG. 40]
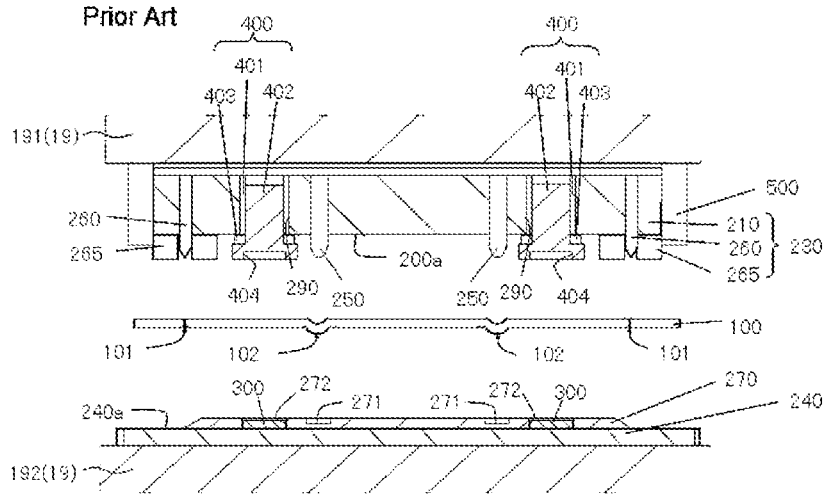
[FIG. 41]
Prior Art
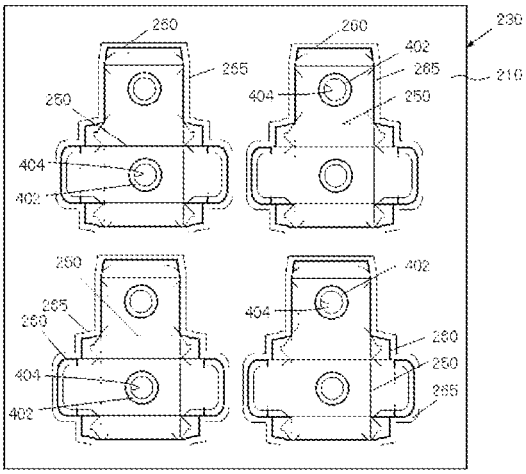
[FIG. 42]
Prior Art
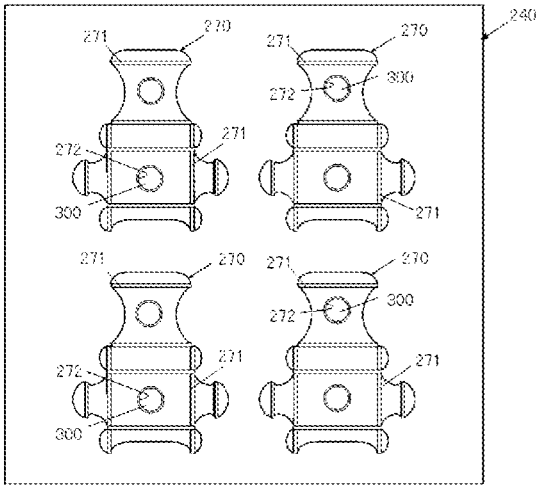

[FIG. 43]
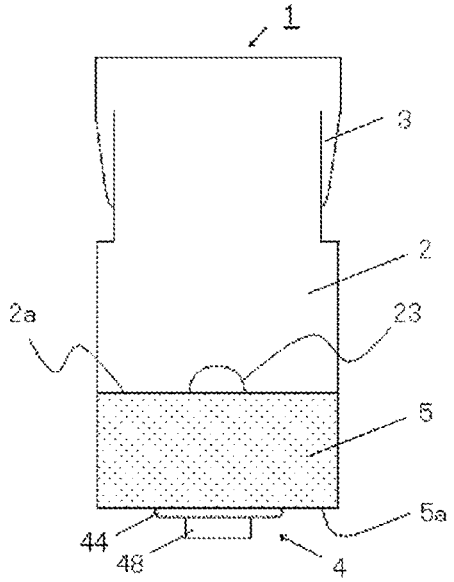
[FIG. 44]
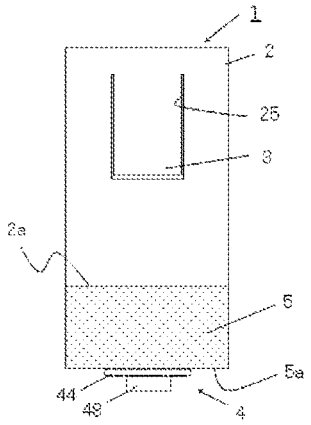
[FIG. 45]
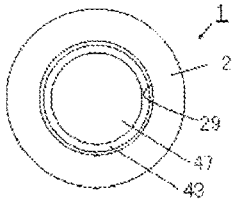
[FIG. 46]
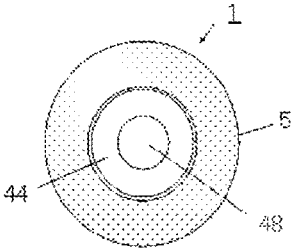

[FIG. 47]
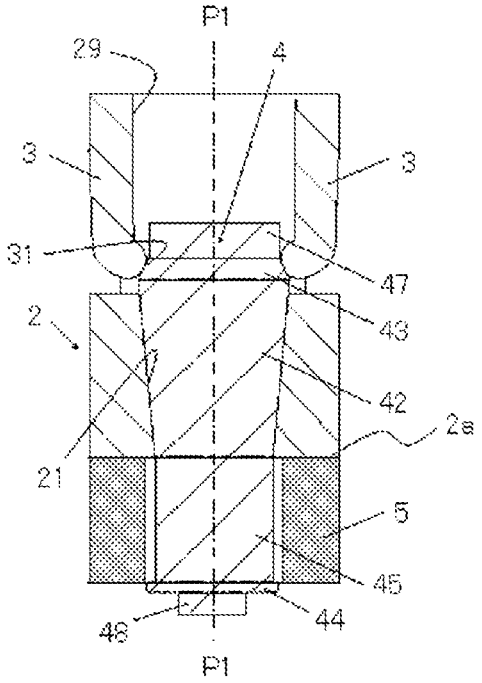
[FIG. 48]
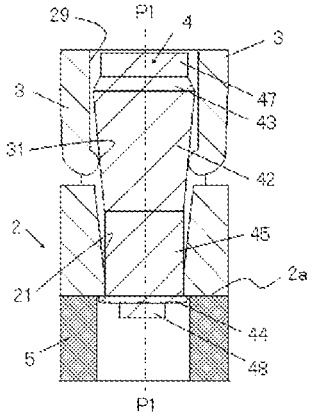
[FIG. 49]
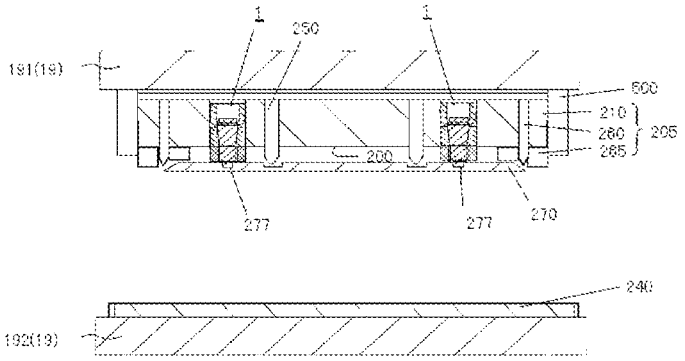

[FIG. 50]
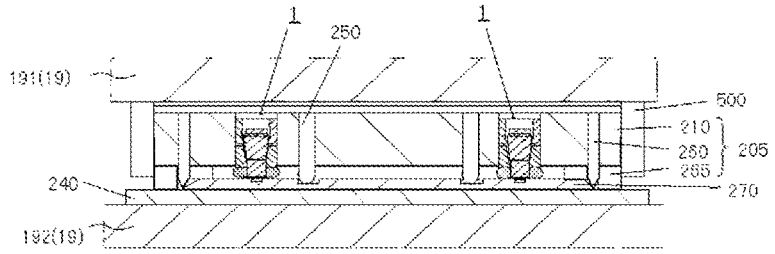
[FIG. 51]
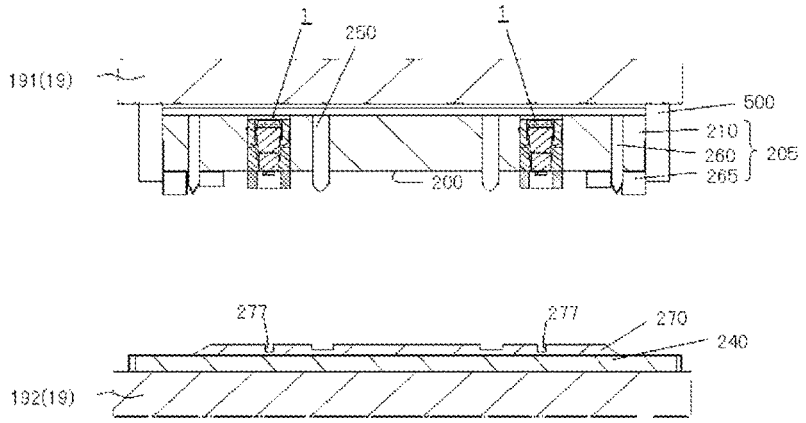
[FIG. 52]
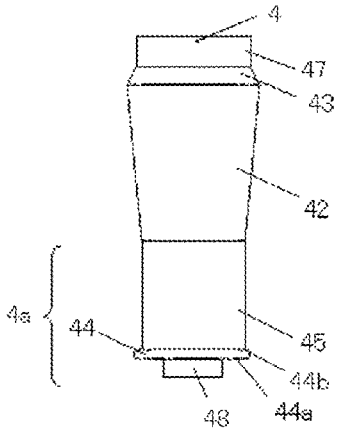
[FIG. 53]
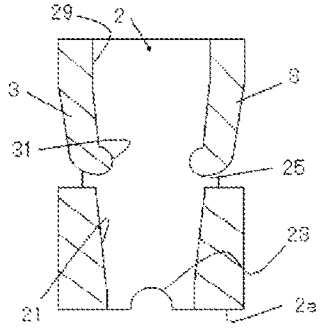

[FIG. 54]
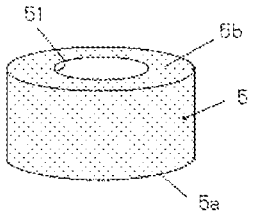
[FIG. 55]
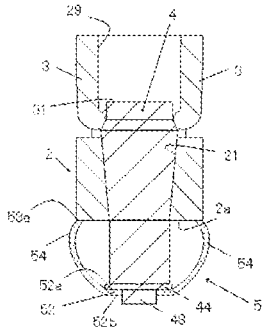
[FIG. 56]
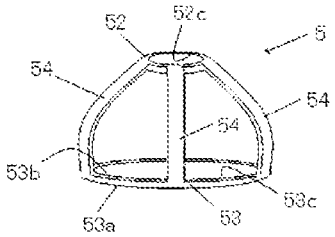
[FIG. 57]
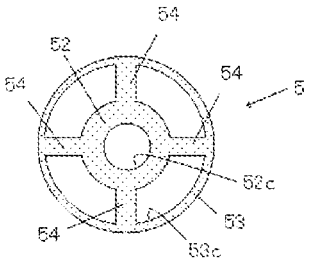
[FIG. 58]
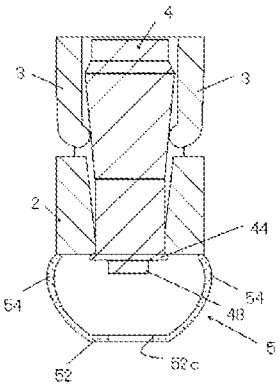

[FIG. 59]
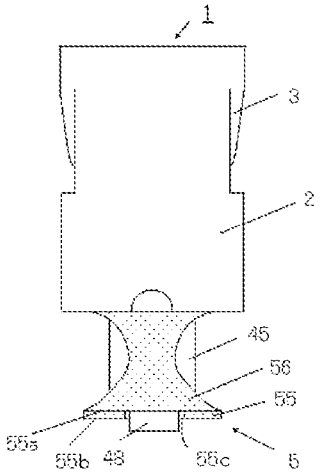
[FIG. 60]
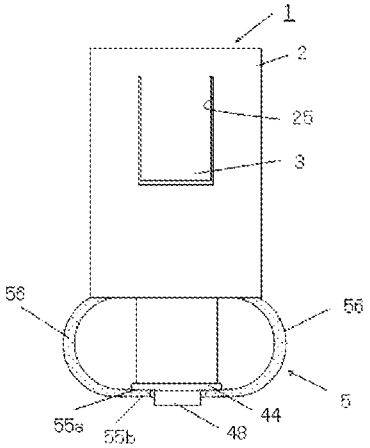
[FIG. 61]
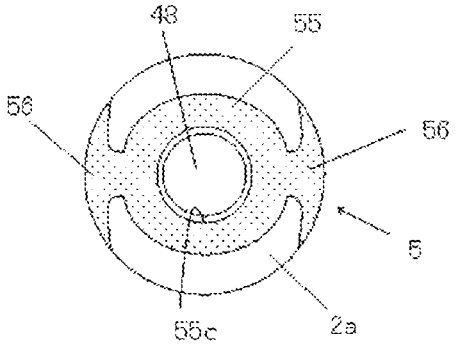

[FIG. 62]
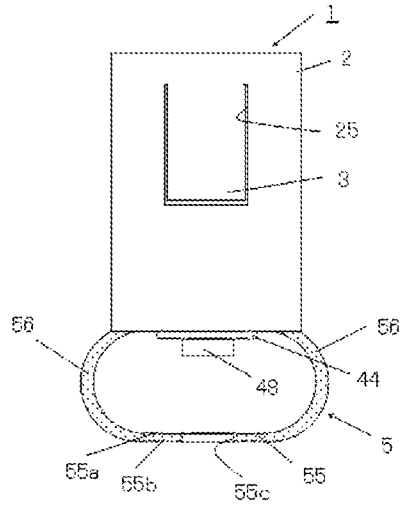
[FIG. 63]
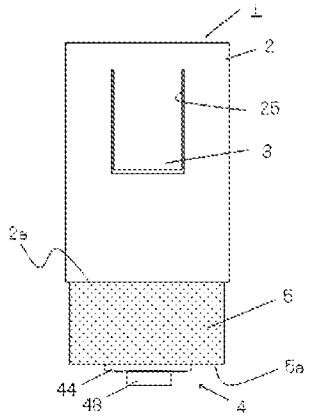
[FIG. 64]
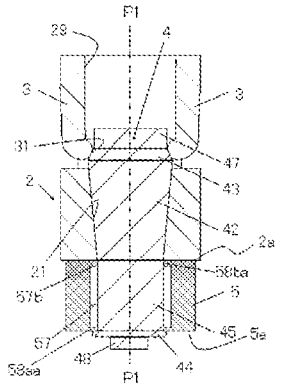

[FIG. 65]
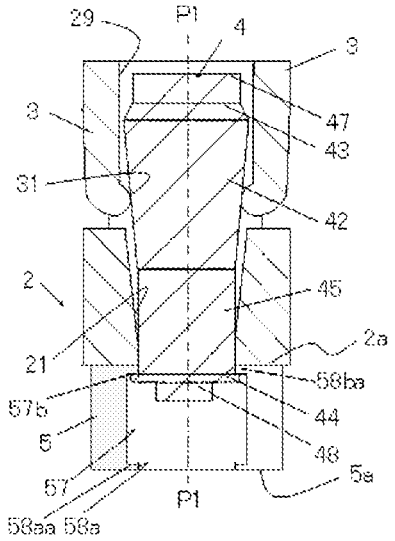
[FIG. 66]
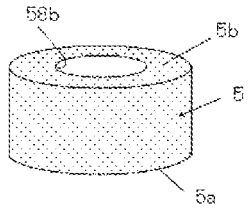
[FIG. 67]
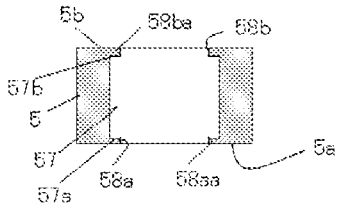

COUNTERPLATE POSITIONING JIG

FIELD OF THE INVENTION

The present invention relates to a counterplate positioning jig used in a blanking machine that punches out sheet for paper articles.

PRIOR ART

Paper articles, also referred to as packaging or paper boxes, may be formed by blanking, folding, and pasting together not only paper, cardboard, or coated paper, but also sheets comprising multiple papers or composite materials of paper, resins, and/or metals. Paper articles are light and convenient to carry, and are widely used in many industrials sectors, including the food industry, the electronic component industry, and the automotive industry.

FIG. 40 is a structural view schematically showing a side elevation of the relationship between a conventional cutting die 230, a counterplate 270, and a cutting plate 240 in a conventional blanking machine 19.

A blanking machine 19 performs blanking processing, when a sheet 100 is inserted, either by raising and then dropping the lower platen 192 or by lowering and then raising an upper platen 101 (FIG. 40).

For example, in the blanking machine 19, the upper platen 191 is provided with a chase 500 to which the cutting die 230 is attached, and the lower platen 192 is provided with a cutting plate 240 (FIG. 40). The counterplate 270 adheres to the cutting plate 240 at a predetermined position (FIG. 40).

A cutting die 230 has arranged thereon a band-like cutting blade 260 and a band-like press rule member 250 disposed on a base 210 (FIG. 40). The cutting die 230 press-cuts an outline of a sheet 100, forming rule lines 102 in predetermined positions (FIG. 40). Plywood is generally used for the material of the base 210, but plastics or hard metals may also be used. The chase 500 is a metal plate with an attached metal frame, forming a reference surface for setting heights on the cutting die 230. The front-rear and left-right position references of the cutting die 230 are created by bringing side surfaces of the cutting die 230 up against the inner sidewalls of the frame of the chase 500 (FIG. 40).

A cutting plate 240 receives the cutting edges of cutting blades 260 provided to the cutting die 230 (FIG. 40). The material of the cutting plate 240 is generally a hard metal such as steel or stainless steel.

A counterplate 270 may also be referred to as a surface block. A counterplate 270 adheres to a cutting plate 240 and receives a sheet 100 (FIG. 40). A counterplate 270 comprises a plate-like, sheet-like, or film-like substrate, and is adhered to the cutting plate 240 using an adhesive applied to the underside thereof. Recently, counterplates have become commercially available that can be reusably stuck on and peeled off through the application of reusable glue on the back surface of the counterplate 270.

A counterplate 270 is manufactured, for example, using an NC machine for manufacturing the cutting die 230 from CAD data. Grooves 271 are milled at positions corresponding to the press rule members 250 of the cutting die 230 and portions are removed so that the sites where the cutting blades 260 make contact form a periphery (FIG. 40). The material of the counterplate 270 may be a synthetic resin such as ABS, PBT, PPS or phenol resin, or may be a hard metal such as steel or stainless steel.

An outline of a paper article on a sheet 100 is denoted by 101. Accordingly, a cutting die 230 cuts out the sheet 100 at the outline 101 and imparts folding creases 102. During this blanking processing, the sheet 100 is cut and receives the folding creases 102 while being pressed down on the cutting die 210 by rubber members 265 to prevent movement of the sheet 100 (FIG. 40).

In summary, a sheet 100 is cut to a predetermined form (at the locations denoted 101) by the cutting blades 260 and is imparted with the folding creases 102 at the prescribed locations by the press rule members 250 and the groove portions 271 on the counterplate 270, thus forming the blank 100 (cut-out sheet 100). The blank 100 is then valley-folded along the folding creases 102 and glued together to assemble a paper article.

In blanking processing, a single operation may form a single blank 100. Alternatively, a single operation may simultaneously form multiple blanks 100.

FIG. 41 is a view of a conventional cutting die 22 for cutting out multiple blanks in a single operation, seen from in front of cutting edges of the cutting blades 260. Furthermore, FIG. 42 is a view of a conventional cutting plate 240 for cutting out multiple blanks, seen from in front of the counterplate 270. In the examples illustrated in FIG. 41 and FIG. 42, four blanks 100 are cut out in a single operation.

As methods for attaching a counterplate to a cutting plate, the methods set out in Patent Documents 1 to 3 are well known, through publication, as conventional technology.

In the methods set out in Patent Documents 1 to 3, as in the method illustrated in FIG. 40, positioning jigs 400 are used which are fixedly installed in mounting holes 290 formed at a plurality of locations in the base 200 of the cutting die.

A conventional positioning jig 400 is configured from a cylindrical housing 401 fixedly installed by press-fitting to mounting holes 290 in the base 200, a shaft member 402 installed in the housing 401, and an annular engaging means 403 sandwiched between the bottom surface 200*a* of the base 200 and the shaft member 402 (FIG. 40).

A counterplate 270 has a plurality of through-holes 272 formed in one-to-one correspondence with the mounting holes 290 of the base 210 of the cutting die 230 (FIG. 40, FIG. 42).

A position marking member 300 is formed by a disc-like or annular engaging means and is adhered to the cutting plate 240 using an adhesive applied to the underside of the marking member 300 (FIG. 40, FIG. 42). In some cases, the marking member 300 is combined with a magnet and adhered to the cutting plate 240 using the magnetic force of the magnet.

A conventional procedure for attaching the counterplate 270 to the cutting plate 240 is to fit position marking members 300 into recesses 404 formed in the bottom ends of shaft members 402 of the positioning jigs 400, and with the jigs in this state, to bring the cutting blades 260 of the cutting die 230 into contact with the cutting plate 240 to mount the marking members 300 on the top surface 240*a* of the cutting plate 240. Then, with the positions of the marking members 300 as a reference, the counter plate 270 is mounted on the top surface 240*a* of the cutting plate 240 (FIGS. 40 to 42). In other words, the counterplate 270 is mounted on the top surface 240*a* of the cutting plate 240 with the inner circumference of the through-holes 272 of the counterplate 270 matched to the outer circumference of the marking members 300 (FIGS. 40 to 42)

PRIOR ART DOCUMENTS

Patent Documents

Patent Document 1: Japanese Patent No. 4772144
Patent Document 2: Japanese Patent No. 5123276
Patent Document 3: U.S. Pat. No. 8,323,163B2

SUMMARY OF THE INVENTION

Problem to be Solved by the Invention

In the conventional technology described in Patent Documents 1 to 3, when a sheet 100 is cut multiple times there is a decrease in the elastic force of an elastic ring 403 formed by an annular engaging means sandwiched between the bottom surface 200*a* of the base 200 and the shaft member 402, and a looseness tends to develop in the assembly of the housing 401 and shaft members 402 (FIG. 40).

The shaft members 402 are long enough to ensure that the marking members 300 make contact with the upper surface 240*a* of the cutting plate. Hence, if the blanking operations are performed as normal with the shaft members 402 still installed, the shaft members 402 often make contact as the sheet is conveyed to the blanking portion, preventing normal conveying of the sheet. Even if conveying is not obstructed, defective blanking can still occur. For instance, the shaft members 402 can leave marks on the sheet 100 when blanking of a sheet 100 is performed. For this reason, with conventional methods, after the marking members 300 have been mounted on the top surface 240*a* of the cutting plate, the chase 500 and the cutting die 230 are again pulled away from the blanking machine so that all the shaft members 402 can be removed from the cutting die 230. The chase 500 and cutting die 230 must subsequently be re-installed on the blanking machine to perform blanking on the sheet 100.

However, it is cumbersome work to remove shaft members 402 from a cutting die 230.

To solve this problem, the present inventors conducted extensive research and made fundamental changes to the configuration of the positioning jig to develop and commercialize a counterplate positioning jig that does not require the shaft members be removed from the cutting die and does not adversely affect cutting operations by, for instance, allowing shaft members to drop down during the blanking operation.

The object of the present invention is to provide a counterplate positioning jig with a novel configuration that makes it easy to mount a counterplate in a predetermined position on a cutting plate, without needing to remove shaft members to perform blanking work, and without shaft members dropping down from the cutting die during blanking work, or contacting the sheet when left in place.

Means to Solve the Problem

The counterplate positioning jig of the present invention is a sheet blanking machine, in which a cutting die equipped with a cutting blade and a cutting plate that receives the cutting blade when the cutting blade moves downward are arranged in opposition, which is installed pointing downwards in each of a plurality of mounting holes formed in the cutting die for the purpose of mounting a counterplate on the cutting plate; which is provided with a sliding shaft member for determining positions on the upper surface of the cutting plate and a housing having an accommodation hole for housing the sliding shaft member; and which is characterized in that the sliding shaft member is operable to move up and down within the housing and stop at a fixed position within the housing, and the sliding shaft member does not drop out from the housing.

Here, "operable to stop at a fixed position" means the sliding shaft member can be stopped at a determined position within the housing, and "fixed position" refers to an "upper limit position" and a "lower limit position".

According to the present invention, the sliding shaft member pulls down from the housing and is caused to stop at the lower limit position, thus allowing the cutting die to approach the cutting plate and mount the marking members on the cutting plate, or mount the counterplate on the cutting plate, and after the marking members are mounted or the counterplate is mounted on the cutting plate, the sliding shaft member can be pushed upward into the housing and stopped at the upper limit position. Since the sliding shaft member is pushed into a position above the leading edge of the blades, normal blanking operations are possible even with the sliding shaft members still installed.

According to the present invention, the sliding shaft member can be stopped at a fixed position within the housing. Hence, even without removing the sliding shaft member from the cutting die, normal blanking operations can be performed without the sliding shaft member striking other parts of the blanking machine.

Since the present invention is configured so that the sliding shaft member does not drop out of the housing, there is no need to remove the sliding shaft member from the cutting die and the sliding shaft member will not fall out during blanking operations The counterplate positioning jig of the present invention is a sheet blanking machine, in which a cutting die equipped with a cutting blade and a cutting plate that receives the cutting blade when the cutting blade moves downward are arranged in opposition, which is installed pointing downwards in each of a plurality of mounting holes formed in the cutting die for the purpose of mounting a counterplate on the cutting plate; which is provided with a sliding shaft member for determining positions on the upper surface of the cutting plate, a housing having an accommodation hole that houses the sliding shaft member, and, an engaging means with a form corresponding to the sliding shaft member and accommodation hole of the housing, and which is characterized in that the sliding shaft member is prevented via the engaging means from dropping out when the sliding shaft member is pulled downwards. The engaging means may be formed to protrude along the accommodation hole of the housing that houses the sliding shaft member, or arranged as a separate member in the manner of the engaging means members to be described later. As long as the engaging means is of a form compatible with the sliding shaft member and the accommodation hole of the housing, the engaging means may, alternatively, be provided on the sliding shaft member. Here, it is preferable that, after mounting the marking member on the top surface of the cutting plate, the sliding shaft member moves upwards.

According to the present invention, it is possible to realize a configuration that does not permit release of the sliding shaft member from the housing by providing an engaging means having an outer circumferential portion with a larger diameter than the diameter of the accommodation hole of the housing, for engaging when the sliding shaft member is housed in the housing. Hence, the sliding shaft member does not need to be removed from the cutting die and will not drop down during blanking work.

Further, the counterplate positioning jig of the present invention is a sheet blanking machine, in which a cutting die equipped with a cutting blade and a cutting plate that receives the cutting blade when the cutting blade moves downward are arranged in opposition, which is mounted pointing downwards in each of a plurality of mounting holes formed in the cutting die for the purpose of mounting a counterplate on the cutting plate; which is provided with a sliding shaft member for determining a position on the upper surface of a cutting plate, and a housing having an accommodation hole formed for housing a sliding shaft member; which is characterized in that a hole-side inclined portion that is inclined towards the lower side is formed in the accommodation hole of the housing as an engaging means, a lower-side inclined portion with an incline direction in the same direction as the hole-side inclined portion is formed on the sliding shaft member, and the sliding shaft member becomes locked when pulled downwards. It is preferable that the hole-side inclined portion is formed as a taper.

According to the present invention, the hole-side inclined portion (engaging means) of the housing and the lower-side inclined portion of the sliding shaft member fit together without leaving a gap. Hence, (in the state in which the hole-side inclined portion is in contact with the lower-side inclined portion), it is possible to obtain precise concentricity between the accommodation hole of the housing and the sliding shaft member, making it easy to mount the counterplate in a precise location on the cutting plate.

Further, the counterplate positioning jig of the present invention is a sheet blanking machine, in which a cutting die equipped with a cutting blade and a cutting plate that receives the cutting blade when the cutting blade moves downward are arranged in opposition, which is mounted pointing downwards in each of a plurality mounting holes formed in the cutting die for the purpose of mounting a counterplate on the cutting plate; which is provided with a housing in which is formed an accommodation hole that houses a sliding shaft member, a sliding shaft member for determining a position which is installed in the housing, and, an engaging means for engaging with the sliding shaft member; and, which is characterized in that a locking structure is provided that locks as a result of the engaging means engaging with an inclined portion of the sliding shaft member, the lower-side lock engages when the sliding shaft member is pulled downwards, and releases when the sliding shaft member is pushed upwards, and the upper-side lock engages after the sliding shaft member moves to the upper-side. Here, it is preferable that the engaging means is a clamping member that clamps the sliding shaft member and that the engaging means applies a circumferential elastic force (biasing force) on the sliding shaft member. Further, it is preferable that the leading ends of the engaging means exhibit the actions of overcoming the axial component force while in contact with the sliding shaft member and releasing the lower-side lock, that the engaging means make contact with the lower-side inclined portion.

According to the present invention, the position marking members are brought into contact with the cutting plate with the lower-side lock engaged. Thereafter, in the time before the cutting blade makes further contact with the cutting plate, the axial component force is overcome, releasing the lower-side lock. The contact of the engaging means with the lower-side inclined portion results in the engaging means exerting an axial force in the direction opposite to the axial central force that was previously being exerted on the surface of the lower-side inclined portion. This force causes the sliding shaft member to move upwards, and the force of the movement causes the sliding shaft member to push against the upper end of the housing, locking the upper-side lock. Hence, even with the sliding shaft member still installed, the sliding shaft member will not contact the sheet during blanking operations. Thus, no interference occurs even if the sliding shaft member remains installed in the housing.

The present invention is characterized in that a hole-side inclined portion, inclined towards the lower side, is formed in the accommodation hole of the housing, a lower-side taper, having an incline that is in the same direction as, but at a different angle to, the hole-side inclined portion, is formed on the sliding shaft member, and pulled the lower-side lock engages when the sliding shaft member is pulled downwards.

According to the present invention, the hole-side inclined portion (engaging means) of the housing and the lower-side taper of the sliding shaft member fit together without leaving a gap. Hence, (in the state in which the hole-side inclined portion is in contact with the lower-side taper) it is possible to obtain precise concentricity between the accommodation hole of the housing and the sliding shaft member, making it easy to mount the counterplate in a precise location on the cutting plate.

The present invention is characterized in that the engaging means is a configuration which engages with the sliding shaft member using the biasing force of an elastic body provided integrally with the housing.

According to the present invention, it is easy to repeatedly perform upper-side locking and lower-side locking, improving reliability. In addition, the number of parts is reduced by integrally forming the engaging means and the housing.

The present invention is characterized in that the engaging means is a C-type concentric snap ring using the biasing force of a leaf spring, ball plunger, or a spring.

According to the present invention, it is easy to increase the movement range of the engaging means without changing the outer diameter of the housing, thus making it simple to adjust the locking force on the sliding shaft member.

According to the present invention, it is easy to increase the movement range of the engaging means without changing the length of the housing, thus making it simple to adjust the locking force on the sliding shaft member.

The counterplate positioning jig of the present invention is further characterized in that an elastic member having elasticity is provided to the bottom surface of the housing for the purpose of removing the tip ends of the sliding shaft member from a hole in the counterplate.

According to the present invention, an elastic member is provided to the bottom surface of the housing, which makes it possible to appropriately remove the leading end (third shaft) of the sliding shaft member from the hole in the counterplate when a counterplate on the cutting plate, due to the elastic force of the elastic member, and this makes it possible to mount a counterplate in a precise position on a cutting plate.

The counterplate positioning jig of the present invention is characterized in that the elastic member is integrally formed with the housing.

According to the present invention, the positioning jig can be manufactured easily and inexpensively since it is possible to integrally form the housing and the elastic member.

Furthermore, the counterplate positioning jig of the present invention is characterized in that the elastic member is provided with a protruding portion on the inside surface of a hole, and the elastic member is engaged by the protruding portion being held between the sliding shaft member and the housing.

According to the present invention, when the sliding shaft member is pulled to the lower limit position, the elastic member (protruding portion) is held between the bottom surface of the housing and the top surface of the plate-like member, and the elastic member will not come off of the positioning jig. In addition, when the sliding shaft member 4 is in the upper limit position, the elastic member (protruding portion) is held between the bottom surface of the housing and the top surface of the plate-like member, and the elastic member 5 will not come off of the positioning jig 1. Therefore, even when formed as a separate member and not integrally formed with the housing, the elastic member will not separate from the bottom surface of the housing.

For the present invention, it is preferable that: a hole-side inclined portion that is inclined towards the lower side is formed in the accommodation hole of the housing; the upper-side inside diameter of the hole-side inclined portion is set to be larger than the lower-side inside diameter of the hole; the engaging means is disposed above the hole-side inclined portion; in the sliding shaft member the following are integrally formed: a lower-side inclined portion, which is disposed above a protruding part that protrudes below the housing, and which has the same direction of inclination as, and a different angle of inclination to, the hole-side inclined portion; as the sliding shaft member stops at a lower limit position when pulled downwards the lower-side lock engages; and, as the sliding shaft member stops at an upper limit position when pushed upwards the upper-side lock engages.

According to the present invention, when the sliding shaft member is pulled downwards, the lower-side inclined portion contacts the hole-side inclined portion, stopping the sliding shaft member at the lower limit position. At this point, the engaging means is in contact with the middle inclined portion (upper-side lock position). As a result of an axial component force generated by the radial direction force exerted by the engaging means, which works on surface of the middle inclined portion, the lower-side inclined portion presses up against the hole-side inclined portion and the lower-side lock engages. In this state, the hole-side inclined portion of the housing and the lower-side inclined portion of the shaft are fitted together with no space therebetween, and so it is possible to obtain precise concentricity between the housing and the shaft. This makes it easy to mount the counterplate in a precise location on the cutting plate. When the blanking machine is operated with the lower lock engaged and the position marking members installed at the time the counterplate is mounted, the marking members make first contact with the cutting plate. Thereafter, in the time before the cutting blade makes contact with the cutting plate, the axial component force is overcome and the lower-side lock releases. The contact of the engaging means with the lower-side inclined portion results in the engaging means exerting an axial force in the opposite direction to the above-described force towards the lower-side inclined portion surface. The force of this movement causes the sliding shaft member to move upwards and press against the upper end of the housing, and the upper-side lock engages. Also, there are positioning members that cause the sliding shaft member to move vertically, without using marking members, in which case the sliding shaft member moves vertically relative to the counterplate.

With the present invention, it is preferable that when the bottom end of the sliding shaft member is pulled downwards to a position as low as or lower than the bottom edge of the cutting blade, the sliding shaft member is stopped at the lower limit position and the lower-side lock engages. Furthermore, it is preferable that when the bottom end of the sliding shaft member is pushed upwards to a position above the bottom edge of the cutting blade, the sliding shaft member is stopped in the upper limit position and the upper-side lock engages.

According to the present invention, the sliding shaft member will not drop out of the cutting die, nor contact the sheet, during blanking work.

Effect of the Invention

With the present invention, the counterplate is easily mounted in a precise position on the cutting plate and falling from the cutting die during blanking work is eliminated, and to the conventional work of removing the jig is not required. Furthermore, even with the sliding shaft member still installed, the sliding shaft member will not contact the sheet during blanking work, so there is no interference with the blanking work.

BRIEF DESCRIPTION OF THE DRAWINGS

FIG. 1 is a front view illustrating a First Example of a counterplate positioning jig of a first embodiment of the present invention.

FIG. 2 is a right side view illustrating the First Example of the counterplate positioning jig of the first embodiment.

FIG. 3 is a plan view illustrating the First Example of the counterplate positioning jig of the first embodiment.

FIG. 4 is a bottom view illustrating the First Example of the counterplate positioning jig of the first embodiment.

FIG. 5 is a cross-sectional view of the First Example of the counterplate positioning jig of the first embodiment, illustrating a state in which a sliding shaft member has been pushed upwards to an upper limit position.

FIG. 6 is a cross-sectional view of the First Example of the counterplate positioning jig of the first embodiment, illustrating a state in which the sliding shaft member has been pulled partway down.

FIG. 7 is a cross-sectional view of the First Example of the counterplate positioning jig of the first embodiment, illustrating a state in which the sliding shaft member has been pulled down to a lower limit position.

FIG. 8 is a front view illustrating a sliding shaft member of the First Example of the counterplate positioning jig 1 of the first embodiment.

FIG. 9 is a cross-sectional view illustrating a housing of the First Example of the counterplate positioning jig of the first embodiment.

FIG. 10 is a cross-sectional view of a Second Example of the counterplate positioning jig of the first embodiment of the present invention, illustrating a state in which a sliding shaft member has been pushed upwards to an upper limit position.

FIG. 11 is a cross-sectional view of the Second Example of the counterplate positioning jig of the first embodiment, illustrating a state in which a sliding shaft member has been pulled partway down.

FIG. 12 is a cross-sectional view of the Second Example of the counterplate positioning jig of the first embodiment, illustrating a state in which a sliding shaft member has been pulled down to a lower limit position.

FIG. 13 is a plan view illustrating an engaging means of the Second Example of the counterplate positioning jig of the first embodiment.

FIG. 14 is a front view illustrating an engaging means of the Second Example of the counterplate positioning jig of the first embodiment.

FIG. 15 is a cross-sectional view of a Third Example of the counterplate positioning jig of the first embodiment of the present invention, illustrating a state in which a sliding shaft member has been pushed upwards to an upper limit position.

FIG. 16 is a cross-sectional view of the Third Example of the counterplate positioning jig of the first embodiment, illustrating a state in which a sliding shaft member has been pulled partway down.

FIG. 17 is a cross-sectional view of the Third Example of the counterplate positioning jig of the first embodiment, illustrating a state in which a sliding shaft member has been pulled down to a lower limit position.

FIG. 18 is a front view illustrating the engaging means of the Third Example of the counterplate positioning jig of the first embodiment.

FIG. 19 is a left side view illustrating the engaging means of the Third Example of the counterplate positioning jig of the first embodiment.

FIG. 20 is a cross-sectional view of a Fourth Example of the counterplate positioning jig of the first embodiment of the present invention, illustrating a state in which the sliding shaft member has been pushed upwards to an upper limit position.

FIG. 21 is a cross-sectional view schematically illustrating the relationship between a cutting die and a cutting plate when the counterplate positioning jig of the first embodiment of the present invention is mounted on the cutting die of a blanking machine. This drawing shows a state in which position marking members have been mounted on the bottom sides of the sliding shaft members of the positioning jig during mounting of the counterplate.

FIG. 22 is a cross-sectional view schematically illustrating the relationship between the cutting die and the cutting plate when the counterplate positioning jig of the first embodiment is mounted on the cutting die of a blanking machine. This drawing shows a state in which position marking members are being mounted on the cutting plate at the time the counterplate is being mounted.

FIG. 23 is a cross-sectional view schematically illustrating the relationship between the cutting die and the cutting plate when the counterplate positioning jig of the first embodiment is mounted on the cutting die of a blanking machine. This drawing shows a state in which the positioning-use marking members have been mounted on the cutting plate at the time the counterplate is being mounted FIG. 24 is a cross-sectional view schematically illustrating the relationship between the cutting die and the cutting plate when the counterplate positioning jig of the first embodiment is mounted on the cutting die of a blanking machine. This drawing shows a state after the counterplate has been mounted on the cutting plate.

FIG. 25 is a view of the cutting die of a blanking machine equipped with the counterplate positioning jig of the first embodiment, looking onto the cutting edges of the cutting blades.

FIG. 26 is a cross-sectional view of a First Example of the counterplate positioning jig of the second embodiment of the present invention, illustrating a state in which the sliding shaft member has been pushed upwards to an upper limit position.

FIG. 27 is a cross-sectional view of the First Example of the counterplate positioning jig of the second embodiment, illustrating a state in which the sliding shaft member has been pulled partway down.

FIG. 28 is a cross-sectional view of the First Example of the counterplate positioning jig of the second embodiment, illustrating a state in which the sliding shaft member has been pulled down to the lower limit position.

FIG. 29 is a front view illustrating a sliding shaft member of the First Example of the counterplate positioning jig of the second embodiment.

FIG. 30 is a cross-sectional view illustrating the housing of the First Example of the counterplate positioning jig of the second embodiment.

FIG. 31 is a cross-sectional view of a Second Example of the counterplate positioning jig of the second embodiment of the present invention, illustrating a state in which a sliding shaft member has been pushed upwards to an upper limit position.

FIG. 32 is a cross-sectional view schematically illustrating the relationship between a cutting die and a cutting plate when the counterplate positioning jig of the second embodiment of the present invention is mounted on the cutting die of a blanking machine. This drawing shows a state in which a counterplate has been mounted on the lower ends of the sliding shaft members of the positioning jigs.

FIG. 33 is a cross-sectional view schematically illustrating the relationship between a cutting die and a cutting plate when the counterplate positioning jig of the second embodiment is mounted on the cutting die of a blanking machine. This drawing shows a state in which the counterplate is being mounted on the cutting plate.

FIG. 34 is a cross-sectional view schematically illustrating the relationship between a cutting die and a cutting plate when the counterplate positioning jig of the second embodiment is mounted on the cutting die of a blanking machine. This drawing shows a state after the counterplate has been mounted on mounted on the cutting plate.

FIG. 35 is a view of the cutting die of a blanking machine equipped with the counterplate positioning jig of the second embodiment, looking onto the cutting edges of the cutting blades.

FIG. 36 is a plan view illustrating the counterplate positioning jig of the first embodiment of the present invention.

FIG. 37 is a cross-sectional view illustrating the counterplate positioning jig of the first embodiment.

FIG. 38 is a plan view illustrating the counterplate positioning jig of the first embodiment of the present invention.

FIG. 39 is a cross-sectional view illustrating the Second Example of the counterplate positioning jig of the first embodiment.

FIG. 40 is cross-sectional view showing the relationship between a cutting die, a counterplate, and a cutting plate in a conventional blanking machine.

FIG. 41 is a view looking onto the cutting edges of the cutting blades of a conventional cutting die.

FIG. 42 is a view of the conventional cutting plate, seen from in front of the counterplate.

FIG. 43 is a front view illustrating a Third Example of the counterplate positioning jig of the second embodiment.

FIG. 44 is a right side view illustrating the Third Example of the counterplate positioning jig of the second embodiment.

FIG. 45 is a plan view illustrating the Third Example of the counterplate positioning jig of the second embodiment.

FIG. 46 is a bottom view illustrating the Third Example of the counterplate positioning jig of the second embodiment.

FIG. 47 is a cross-sectional view of the Third Example of the counterplate positioning jig of the second embodiment, illustrating a state in which the sliding shaft member has been pulled down to a lower limit position.

FIG. 48 is a cross-sectional view of the Third Example of the counterplate positioning jig of the second embodiment, illustrating a state in which the sliding shaft member has been pushed upwards to an upper limit position.

FIG. 49 is a cross-sectional view schematically illustrating the relationship between the cutting die and the cutting plate when the Third Example of the counterplate positioning jig of the second embodiment is mounted on the cutting die of the blanking machine. This drawing shows the state in which the counterplate has been mounted on the lower ends of the sliding shaft members of the positioning jigs.

FIG. 50 is a cross-sectional view schematically illustrating the relationship between the cutting die and the cutting plate when the Third Example of the counterplate positioning jig of the second embodiment is mounted on the cutting die of the blanking machine. This drawing shows a state in which the counterplate is being mounted on the cutting plate.

FIG. 51 is a cross-sectional view schematically illustrating the relationship between the cutting die and the cutting plate when the counterplate positioning jig of the Third Example of the second embodiment is mounted on the cutting die of the blanking machine. This drawing shows a state after the counterplate has been mounted on the cutting plate.

FIG. 52 is a front view illustrating a sliding shaft member of the Third Example of the counterplate positioning jig of the second embodiment.

FIG. 53 is a cross-sectional view illustrating the housing of the Third Example of the counterplate positioning jig of the second embodiment.

FIG. 54 is a perspective view illustrating an elastic member of the Third Example of the counterplate positioning jig of the second embodiment.

FIG. 55 is a cross-sectional view of a Fourth Example of the counterplate positioning jig of the second embodiment, illustrating a state in which the sliding shaft member has been pulled down to a lower limit position.

FIG. 56 is a perspective view illustrating an elastic member of the Fourth Example of the counterplate positioning jig of the second embodiment.

FIG. 57 is a plan view illustrating an elastic member of the Fourth Example of the counterplate positioning jig of the second embodiment.

FIG. 58 is a cross-sectional view of the Fourth Example of the counterplate positioning jig of the second embodiment, illustrating a state in which the sliding shaft member has been pushed upwards to an upper limit position.

FIG. 59 is a front view illustrating a Fifth Example of the counterplate positioning jig of the second embodiment.

FIG. 60 is a cross-sectional view of a Fifth Example of the counterplate positioning jig of the second embodiment, illustrating a state in which the sliding shaft member has been pulled down to a lower limit position.

FIG. 61 is a front view illustrating an elastic member of the Fifth Example of the counterplate positioning jig of the second embodiment.

FIG. 62 is right side view of the Fifth Example of the counterplate positioning jig of the second embodiment, illustrating a state in which a sliding shaft member has been pushed upwards to an upper limit position.

FIG. 63 is a right side view illustrating a Sixth Example of the counterplate positioning jig of the second embodiment.

FIG. 64 is a cross-sectional view of a Sixth Example of the counterplate positioning jig of the second embodiment, illustrating a state in which the sliding shaft member has been pulled down to a lower limit position.

FIG. 65 is a cross-sectional view of the Sixth Example of the counterplate positioning jig of the second embodiment, illustrating a state in which the sliding shaft member has been pushed upwards to an upper limit position.

FIG. 66 is a perspective view illustrating an elastic member of the Sixth Example of the counterplate positioning jig of the second embodiment.

FIG. 67 is a cross-sectional view illustrating an elastic member of the Sixth Example of the counterplate positioning jig of the second embodiment.

EMBODIMENTS OF THE INVENTION

The following describes embodiments of the present invention using the drawings.

First Embodiment

A sheet blanking machine 19, in which a cutting die 205 equipped with cutting blades 260 is disposed in opposition to a cutting plate 240 that receives the cutting blades 260 when the blades move downward, and which uses counterplate positioning jigs 1 of a first embodiment of the present invention to mount a counterplate 270 on a cutting plate 240. A plurality of counterplate positioning jigs 1 are mounted pointing downwards in mounting holes 290 formed at a plurality of sites in the cutting die 205 (see FIG. 24). Each counterplate positioning jig 1 includes: a housing 2 having formed therein an accommodation hole 29 into which a sliding shaft member 4 moves in and out; a sliding shaft member 4, which is installed in the housing 2 and operates to mount a position marking member 300 on the upper side of the cutting plate 240; and, an engaging means (holding means) 3 that adjusts the force with which the sliding shaft member 4 is held within the housing 2. Each jig 1 operates to mount the position marking member 300, which is used when mounting the counterplate 270 on the cutting plate 240 (see FIG. 21 and FIG. 23).

FIG. 36 is a plan view showing a First Example of the position marking member 300 according to the present embodiment. FIG. 37 is a cross-sectional view of the same. The position marking member 300 is disc-shaped. The marking member 300 is an engaging means 3 comprising a sponge such as urethane foam, with a sheet-like adhesive, such as double-sided tape, applied to the bottom surface thereof.

First Example

FIG. 1 is a front view illustrating the First Example of the counterplate positioning jig 1 of the first embodiment. FIG. 2 is a right side view illustrating the First Example of the counterplate positioning jig 1 of the present embodiment. FIG. 3 is a plan view illustrating the First Example of the counterplate positioning jig 1 of the present embodiment. FIG. 4 is a bottom view illustrating the First Example of the counterplate positioning jig 1 of the present embodiment. FIGS. 5 to 7 are cross-sectional views illustrating the First Example of the counterplate positioning jig 1 of the present embodiment, corresponding to the section along line A-A in FIG. 2 of these drawings. FIG. 5 is a view showing the sliding shaft member 4 in a state of being pushed up to an upper limit position. FIG. 6 is a view showing the sliding shaft member 4 in a state of being pulled partway down. FIG. 7 is a view showing the sliding shaft member 4 in a state of being pulled downward to a lower limit position. FIG. 8 is a front view showing the sliding shaft member 4 of the First Example of the counterplate positioning jig 1 of the present embodiment. FIG. 9 is a cross-sectional view illustrating the housing 2 of the First Example of the counterplate positioning jig 1 of the present embodiment.

The counterplate positioning jig 1 of the present embodiment is configured from a cylindrical housing 2, a sliding shaft member 4 that is installed within the housing 2, and an engaging means 3 that alternates between a lower-side lock and an upper-side lock on the sliding shaft member 4 within the housing 2 (FIGS. 1 to 9). The housing 2 and the sliding shaft member 4 have rotational symmetry about line P1-P1 (FIGS. 5 to 7).

The engaging means 3 is provided inside the cylindrical body of the housing 2 (FIGS. 5 to 7, and FIG. 9). The First Example is a configuration in which the engaging means 3 is fixed at one end and uses the biasing force of an elastic body, a protrusion 31 on the lower side engaging with the sliding shaft member 4 (FIGS. 5 to 7, and FIG. 9). In the First Example, the housing 2 and the engaging means 3 are integrally formed. A hemispherical form is provided at the tip of the engaging means 3, and this hemispherical tip portion contacts a lower-side inclined portion 42 or the like. The housing 2 comprises, for example, a hard plastic, a hard metal, or a compound material that is a combination of these. The engaging means 3 exhibits an engaging force as a means of alternately locking the lower-side lock and the upper-side lock, which is also a means for releasing the locks using a force in opposition to this engaging force, while permitting up and down movement of the sliding shaft member 4. In the First Example, the side surface of the housing 2 has window portions 25 on both sides of the engaging means 3. Increasing the vertical length of these window portions 25 makes it possible to set a wide range of permitted movement for the engaging means 3 (FIG. 2).

A housing 2 has a through-hole 29 formed in the cylindrical body thereof (FIG. 9). The upper-side inside diameter of a hole-side inclined portion 21 of the housing 2 is set to be larger than the lower-side inside diameter (FIG. 30). The diameter of the through-hole at the bottom end surface 2*a* side of the housing 2 becomes gradually smaller as one moves downwards.

The housing 2 has the hole-side inclined portion 21 and window portions 25 formed, in the stated order as one moves from bottom to top, along the through-hole 29 (FIG. 9). The upper-side inside diameter of the hole-side inclined portion 21 of the housing 2 is set to be larger than the lower-side inside diameter, and an engaging means 3 is provided to the upper side of the hole-side inclined portion 21 (FIG. 9).

The sliding shaft member 4 has a plate-like member 41 for mounting the position marking member 300, the plate-like member 41 being disposed to the bottom of a columnar body (FIGS. 5 to 7). The plate-like member 41 has a recess 414 for mounting the position marking member 300 (FIGS. 5 to 7). The bottom end surface of the plate-like member 41 is denoted by 41*a*, and the top end surface of the plate-like member 41 is denoted by 41*b*. When the sliding shaft member 4 moves upwards, the top surface of the plate-like member 41 contacts the bottom surface 2*a* of the housing 2, stopping the movement. The sliding shaft member 4 is integrally formed by, going from bottom to top, the plate-like member 41, a lower-side shaft 45, a lower-side inclined portion 42, a middle inclined portion 43, and a second shaft 47. The plate-like member 41 and lower-side shaft 45 configure a protruding portion of the sliding shaft member 4. The sliding shaft member 4 comprises, for example, a hard plastic, a hard metal, or a compound material that is a combination of these. Note that the symbol H1 is used to denote the thickness of the plate-like member 41 (FIG. 23).

The lower-side inclined portion 42 of the sliding shaft member 4 has the same direction of inclination as, and a different angle of inclination to, the hole-side inclined portion 21 of the housing 2 (FIGS. 5 to 7). The middle inclined portion (upper-side lock position) 43 of the sliding shaft member 4 is inclined in the opposite direction to the hole-side inclined portion 21 of the housing 2. In other words, the middle inclined portion (upper-side lock position) 43 and the lower-side inclined portion 42 are inclined in opposite directions (FIG. 8). Further, the vertical dimensions of the sliding shaft member 4 are, in descending order of length, length L5 of the lower-side shaft (protruding portion) 45, length L2 of the lower-side inclined portion 42, and length L3 of the middle inclined portion 43 (FIG. 8). In short, the relationship is L5>L2>L3 (FIG. 8).

Next, a method of using the positioning jig 1 used in the present example will be described.

The sliding shaft member 4 is pulled until the bottom end of the sliding shaft member 4 is at the same level as or below the bottom edge 260*a* of the cutting blade 260. Note that when the positioning jig of the present invention for mounting a counterplate 240 is press-fitted into the mounting holes 290 formed in the cutting die, the press-fitting may be performed with the sliding shaft member 4 in the pulled state or the sliding shaft member 4 may be pulled after the press-fitting. The sliding shaft members can be pulled manually (using fingers) or using a tool such as pliers. A through-hole 29 is formed in the housing 2, so after the sliding shaft member 4 is pulled from above manually (using fingers) or using a tool such as pliers, and in this state, the positioning jig 1 for mounting a counterplate 240 may be press-fitted in the mounting hole 290.

With the lower-side lock engaged, position marking members 300 are mounted to the bottom side of the sliding shaft member 4, the cutting blades 260 are brought into contact with the cutting plate 240, and the marking members 300 are mounted on the upper side of the cutting plate 240. The counterplate 270 is mounted in alignment with the marking members 300. Then, by pulling the sliding shaft member 4 until the bottom end of the sliding shaft member 4 is at the same level as or below the bottom edges 260*a* of the cutting blades 260 and/or the leading edges of the rule line members 250, and with the lower-side lock engaged, by mounting the counterplate 270 on the lower end of the sliding shaft member 4 and causing the cutting blades 260 to contact the cutting plate 240, the counterplate 270 is mounted on the upper side of the cutting plate 240. Note that the symbol 265 denotes rubber provided around the external circumference of the cutting blades 260, the thickness of this rubber being denoted by H3. If H5 denotes the position of the sliding shaft member 4 when pulled to the lower side, then H5>H3, as illustrated in FIG. 21.

When the marking member 300 is mounted, the sliding shaft member 4 is pushed in under resistance from the engagement force of the engaging means 3, and now slides in an upward movement. As a result of the upward movement of the cutting plate 240, the lower end of the sliding shaft member 4 is pushed upwards until it is higher than the lower edge of the cutting blade 260. In turn, the lower-side inclined portion 42 passes over the leading-end hemispherical portion of the sliding shaft member 4 so that the hemispherical portion locates at a root portion of the lower-side inclined portion 42. As a result, the sliding shaft member 4 is stopped at an upper end portion and the upper-side lock engages (FIG. 5). At this time, the upper surface of the plate 41 is in contact with the lower end surface of the housing. In this position, the bottom end of the sliding shaft member 4 is pushed into a higher position than the leading edges 260*a* of the cutting blades 260 or a more informed position than the leading edges of the rule line members 25) (FIG. 23). Hence, even with the sliding shaft member 4 still installed, the lower-side tip end of the sliding shaft member 4 will not contact the workpiece sheet 100 during blanking operations.

Here, at some point before the cutting blade 260 makes contact with the cutting plate 270, the leading-end hemispherical portion of the engaging means 3 (see symbol F in FIG. 5) overcomes the axial component force, and the lower-side lock is released (FIG. 7). The sliding shaft member 4 moves upwards, and the contact of the leading-end hemispherical portion with the lower-side inclined portion 42 results in the engaging means 3 exerting an axial force in an opposite direction to the force exerting on the lower-side inclined portion surface 21, and force of this movement causes the sliding shaft member 4 to move upwards and press against the upper end of the housing 2 (FIG. 5).

Second Example

FIGS. 10 to 12 are cross-sectional views illustrating a Second Example of the counterplate positioning jig 1 of the first embodiment. FIG. 10 is a view showing the sliding shaft member 4 in a state of being pushed up to an upper limit position. FIG. 11 is a view showing the sliding shaft member 4 in a state of being pulled partway down. FIG. 12 is a view showing the sliding shaft member 4 in a state of being pulled downward to a lower limit position. Note that the sliding shaft member 4 is identical to that of the First Example.

The counterplate positioning jig 1 of the present embodiment is configured from a cylindrical housing 2, a sliding shaft member 4 that is installed within the housing 2, and an engaging means 3 that alternates between a lower-side lock and an upper-side lock with respect to the sliding shaft member 4 inside the housing 2 (FIGS. 10 to 12). The housing 2 has rotational symmetry about line P1-P1 (FIGS. 10 to 12).

The engaging means 3 is disposed to the inside of the cylindrical body of the housing 2 (FIGS. 10 to 12). The engaging means 3 is illustrated in plan view in FIG. 13 and in front view in FIG. 14. In an unloaded state, the engaging means 3 has an inside diameter that is smaller than the lower-side shaft 45 and the shaft portion 47 of the sliding shaft member 4, and is formed from a material that provides an elastic force, such as a spring material. In the Second Example, the engaging means 3 is housed in a locating groove 27 inside the housing with the sliding shaft member 4 passing therethrough, so that a constricting force in the radial direction acts on the sliding shaft member 4 (FIGS. 10 to 12).

The housing 2 has a through-hole 29 formed in the cylindrical body thereof (FIGS. 10 to 12). The housing 2 is formed with the hole-side inclined portion 21, the locating groove 27, and an upper-side inclined portion 24 formed, in the stated order as one moves from bottom to top, along the through-hole 29 (FIGS. 10 to 12). The upper-side inside diameter of the hole-side inclined portion 21 of the housing 2 is set to be larger than the lower-side inside diameter (FIGS. 10 to 12). Accordingly, with this configuration, movement towards the upper side is easier than movement towards the lower side.

Hence, with the present embodiment, when the sliding shaft member 4 is pulled downwards in opposition to the engaging force (biasing force) of the engaging means 3, the lower-side lock engages. When the sliding shaft member 4 is pushed upwards in opposition to the engaging force (biasing force) of the engaging means 3, the lower-side lock is released, and the sliding shaft member 4 moves to the upper side and then the upper-side lock engages.

Third Example

FIGS. 15 to 17 are cross-sectional views illustrating a Third Example of the counterplate positioning jig 1 of the first embodiment. FIG. 15 is a view showing the sliding shaft member 4 in a state of being pushed up to an upper limit position. FIG. 16 is a view showing the sliding shaft member 4 in a state of being pulled partway down. FIG. 17 is a view showing the sliding shaft member 4 in a lower limit position after being pulled downward. Note that the sliding shaft member 4 is identical to that of the First Example.

The counterplate positioning jig 1 of the present embodiment is configured from a cylindrical housing 2, a sliding shaft member 4 installed in the housing 2, and an engaging means 3 that alternates between the lower-side lock and the upper-side lock with respect to the sliding shaft member 4 inside the housing 2 (FIGS. 15 to 17). The housing 2 has rotational symmetry about line P1-P1 (FIGS. 15 to 17).

The engaging means 3 is disposed to the inner side of the cylindrical body of the housing 2 (FIGS. 15 to 17). The engaging means 3 is illustrated in front view in FIG. 18 and in side view in FIG. 19. The engaging means 3 is provided with a bent portion 31, which, when in an unloaded state, is positioned nearer to the central axis of the shaft than to the lower-side shaft 45 or the second shaft 47 outer periphery, and is made of a material that provides an elastic force, such as a spring material. Thus, when the sliding shaft member 4 is installed in the housing 2, a force (biasing force) constantly presses the sliding shaft member 4 from the side. Accordingly, the position of the engaging means 3 forms a reference position with the sliding shaft member 4 moving either against the biasing force or with the biasing force. Beyond this position, the sliding shaft member 4 is switched into either the upper-side or lower-side locked state.

The housing 2 has a through-hole 29 formed in the cylindrical body thereof (FIGS. 15 to 17). The housing 2 is tapered, with the hole-side inclined portion 21 and a side surface window 26 being provided, in the stated order as one moves from bottom to top, along the through-hole 29 (FIGS. 15 to 17). The engaging means 3 includes a bent portion 31 having a shallow V-form, with one side of the V-form in contact with the taper (inclined portion) 43. Also, the window 26 is disposed such that the bent portion 31 can bend away from the shaft with a bending portion 39 as the fulcrum. The upper-side inside diameter of the hole-side inclined portion 21 of the housing 2 is set to be larger than the lower-side upper diameter, so that a small space is created between the two members (FIGS. 15 to 17).

Fourth Example

FIG. 20 is a cross-sectional view illustrating a Fourth Example of the counterplate positioning jig 1 of the first embodiment. FIG. 20 is a view showing the sliding shaft member 4 in a state of being pushed up to an upper limit position. A ball plunger is used for the engaging means 3. The operation and configuration of this element correspond to those of the First Example to the Third Example. Note that the sliding shaft member 4 is identical to that of the First Example.

Second Embodiment

A sheet blanking machine 19, in which a cutting die 205 equipped with cutting blades 260 is arranged in opposition to a cutting plate 240 that receives the cutting blades 260 when the blades move downward, which uses the counterplate positioning jigs 1 of a second embodiment of the present invention to mount a counterplate 270 on the cutting plate 240. A plurality of the counterplate positioning jigs 2 are installed pointing downwards in mounting holes 290 formed at a plurality of sites in the cutting die 205, and grooves (circular grooves) are formed in the top surface of the counterplate 270 using the leading ends of the sliding shaft member 4 (see FIG. 32).

FIGS. 26 to 28 are cross-sectional views illustrating a First Example of the counterplate positioning jig 1 of the second embodiment. FIG. 26(*a*) is a view showing the sliding shaft member 4 in a state of being pushed up to an upper limit position. FIG. 27 is a view showing the sliding shaft member 4 in a state of being pulled partway down. FIG. 28 is a view showing the sliding shaft member 4 in a state of being pulled downward to a lower limit position. FIG. 29 is a cross-sectional view illustrating the sliding shaft member 4 of the First Example of the counterplate positioning jig 1 of the present embodiment. FIG. 30 is a cross-sectional view illustrating the housing 2 of the First Example of the counterplate positioning jig 1 of the present embodiment.

FIG. 26(*b*) shows an example in which a plurality of engaging means 3 are disposed in the vertical direction. With such a configuration, the sliding shaft member can enter the lower-side locked state when pulled downwards, without requiring the formation of a hole-side inclined portion that slopes towards the lower-side lock in the accommodation hole 29 of the housing 2.

The counterplate positioning jig 1 of the present embodiment is configured from a cylindrical housing 2, a sliding shaft member 4 that is installed in the housing 2, and an engaging means 3 that alternates between a lower-side lock and an upper-side lock with respect to the sliding shaft member 4 within the housing 2 (FIGS. 26 to 28). The housing 2 and the sliding shaft member 4 have rotational symmetry about line P1-P1 (FIGS. 26 to 30).

The engaging means 3 is disposed to the inner side of the cylindrical body of the housing 2 (FIGS. 26 to 28). The engaging means 3 is illustrated in plan view in FIG. 13 and in front view in FIG. 14. In an unloaded state, the engaging means 3 has an inside diameter that is smaller than the shaft 45 and the shaft 47 of the sliding shaft member 4, and is formed from a material that provides an elastic force, such as a spring material. In the First Example, the engaging means 3 is housed in a locating groove 27 within the housing with the sliding shaft member 4 passing therethrough, so that a constricting force in the radial direction acts constantly on the sliding shaft member 4.

The housing 2 has a through-hole formed in the cylindrical body thereof (FIG. 30). The lower end surface of the housing 2 is denoted by the symbol 2*a*. The housing 2 has a hole-side inclined portion 21, the locating groove 27, and the upper-side inclined portion 24 formed, in the stated order as one moves from bottom to top, along the through-hole 29 (FIG. 30). The upper-side inside diameter of a hole-side inclined portion 21 of the housing 2 is set to be larger than the lower-side inside diameter (FIG. 30).

The sliding shaft member 4 has a third shaft 48 formed below the lower-side shaft 45 that is narrower than the lower-side shaft 45 (FIG. 29). The counterplate 270 is mounted on the third shaft 48, and holes 277 are formed in the counterplate 270 for attachment to the third shaft (FIG. 32).

The sliding shaft member 4 is integrally formed by, going from bottom to top, the third shaft 48, the lower-side shaft 45, the lower-side inclined portion 42, the middle inclined portion 43, and the second shaft 47. The third shaft 48 and the lower-side shaft 45 form the protruding portion of the sliding shaft member 4. The sliding shaft member 4 comprises, for example, a hard plastic, a hard metal, or a compound material that is a combination of these.

The lower-side inclined portion 42 of the sliding shaft member 4 has the same direction of inclination as, and a different angle of inclination to, the hole-side inclined portion 21 of the housing 2 (sufficiently different to allow a gap to form) (FIGS. 26 to 30). The middle inclined portion 43 of the sliding shaft member 4 is inclined in the opposite direction to the hole-side inclined portion 21 of the housing 2. In short, the middle inclined portion 43 and the lower-side inclined portion 42 are inclined in opposite directions (FIG. 29).

Further, the vertical dimensions of the sliding shaft member 4 are, in descending order of length, length L5 of the lower-side shaft 45, length L2 of the lower-side inclined portion 42, and length L3 of the middle inclined portion 29 (FIG. 29). In short, the relationship is L5>L2>L3 (FIG. 29).

In this case, the counterplate 270 is mounted on the upper side of the cutting plate 240 by pulling the sliding shaft member 4 until the lower end thereof is level with or below the cutting edge 260*a* of the cutting blade 260 or the leading edge of the rule line member 250, and, with the sliding shaft member 4 in this state, fitting the leading ends 48 of the sliding shaft members 4 into the holes 277 of the counterplate 270 and then bringing the counterplate 270 in this state into contact with the cutting plate 240 (FIG. 34). Note that the symbol 265 denotes rubber that is provided around the periphery of the cutting blades 260. If H3 denotes the thickness of this rubber, H5 denotes the position of the sliding shaft member 4 when pulled to the lower side, and H7 denotes the position of the tips 48 of the sliding shaft member 4*b* when the leading ends of the sliding shaft members 4*b* are fitted into the holes 277 of the counterplate 270 (FIG. 34), then the relationship is H7>H3, as illustrated in FIG. 32.

In the present embodiment, the sliding shaft members are installed pointing downwards in mounting holes 290 formed at a plurality of sites in the cutting die 205 for mounting the counterplate 270 on the cutting plate 240 (see FIG. 32), and the jigs are used without using the marker members 300.

Second Example

FIG. 31 is a cross-sectional view illustrating a Second Example of the counterplate positioning jig 1 of the second embodiment. The Second Example differs from the First Example only in the configuration of the sliding shaft member 4, the difference being that a disk 41 is added between the lower-side shaft 45 and the third shaft 48. In other ways, the Second Example is identical to the above-described embodiments.

Third Example

FIG. 43 is a front view illustrating a Third Example of the counterplate positioning jig of the second embodiment, and FIG. 44 is a right side view illustrating the Third Example of the counterplate positioning jig of the second embodiment. FIG. 45 is a plan view illustrating the Third Example of the counterplate positioning jig of the second embodiment, and FIG. 46 is a bottom view illustrating the Third Example of the counterplate positioning jig of the second embodiment. FIG. 47 is a cross-sectional view of the Third Example of the counterplate positioning jig of the second embodiment, illustrating a state in which the sliding shaft member has been pulled downwards to a lower limit position. FIG. 48 is a cross-sectional view of the Third Example of the counterplate positioning jig of the second embodiment, illustrating a state in which the sliding shaft member has been pushed upwards to the upper limit position.

The counterplate positioning jig of the Third Example of the second embodiment differs from the counterplate positioning jig of the First Example and the Second Example in the inclusion of an elastic member 5 at the lower surface 2*a* of the housing 2.

In the Second Embodiment, by mounting the tips 48 of the sliding shaft members 4 in the holes 277 of the counterplate 270 and bringing close the cutting die 205 and cutting plate 240, the counterplate 270 is precisely mounted on the cutting plate 240 using an adhesive means, such as an adhesive agent, provided to the bottom surface of the counterplate 270.

However, problems can occur with this arrangement. Specifically, when the counterplate 270 is mounted on the cutting plate 240, the tips 48 of the sliding shaft members 4 can fail to release cleanly from the holes 277 in the counterplate 270, thus preventing the counterplate 270 from being mounted on the cutting plate 240.

Hence, in the Third Example, an elastic member 5 is provided to the bottom surface 2*a* of the housing 2 with the objective of using the elastic force of the elastic member 5 to give a clean release of the tip 48 of the sliding shaft member 4 from the holes 277 in the counterplate 270.

The counterplate positioning jig 1 of the present embodiment is configured from a cylindrical housing 2, a sliding shaft member 4 installed in the housing 2, an engaging means 3 that alternates between a lower-side lock and an upper-side lock with respect to the sliding shaft member 4 inside the housing 2, and a cylindrical elastic member 5 provided to the bottom surface 2*a* of the housing 2 (FIGS. 43 to 46). The housing 2, the sliding shaft member 4, and the elastic member 5 have rotational symmetry about the line P1-P1 (FIG. 47 and FIG. 48).

The engaging means 3 is disposed to the inner side of the cylindrical body of the housing 2 (FIG. 51). In the Third Example, the engaging means 3 uses the biasing force of an elastic body that is fixed at one end to cause a protrusion 31 on the lower side to engage with the sliding shaft member 4 (FIG. 47, and FIG. 48). The projection 31 on the lower end side has a hemispherical shape, and engages with the sliding shaft member 4 at the upper limit position (FIG. 48) and the lower limit position (FIG. 47) thorough contact with the lower-side inclined portion 42 and the middle inclined portion 43 of the sliding shaft member 4. The housing 2 comprises, for example, a hard plastic, a hard metal, or a compound material that is a combination of these. The engaging means 3 generates engaging forces as a means of alternately locking the lower-side lock and the upper-side lock while permitting vertical movement of the sliding shaft member 4, and allows the locks to be released by forces that oppose the engaging forces. In the Third Example, the side surface of the housing 2 has window portions 25 on both sides of the engaging means 3. Increasing the vertical length of these window portions 25 extends the range of movement setting for the engaging means 3 (FIG. 44).

FIG. 53 is a cross-sectional view illustrating the housing of the Third Example of the counterplate positioning jig of the second embodiment.

The housing 2 has a through-hole 29 formed in the cylindrical body thereof. The upper-side inside diameter of a hole-side inclined portion 21 of the housing 2 is set to be larger than the lower-side inside diameter The diameter of the through-hole on the bottom surface 2*a* side of the housing 2 becomes gradually smaller as one moves towards the lower side.

The housing 2 is formed with the hole-side inclined portion 21 and the window portions 25 formed, in the stated order as one moves from bottom to top, along the through-hole 29. The upper-side inside diameter of the hole-side inclined portion 21 of the housing 2 is set to be larger than the lower-side inner diameter, and the engaging means 3 is provided above the hole-side inclined portion 21.

FIG. 54 is a perspective view illustrating the elastic member of the Third Example of the counterplate positioning jig of the second embodiment.

The elastic member 5 is provided to enable clean release of the tips 48 (third shaft) of the sliding shaft member 4 from the holes 277 in the counterplate 270 when mounting the counterplate 270 on the cutting plate 240, and is provided to the bottom surface 2*a* of the housing 2 (FIG. 47 and FIG. 48).

The elastic member 5 has elastic properties and is, for example, from a single resin or a composite resin material.

The housing 2 and the elastic member 5 is are integrally formed but have differing elastic moduli, with the elastic member 5 having a lower elastic modulus than the housing 2.

The elastic member 5 is cylindrical and is provided with a columnar hole 51 that centrally pierces the elastic member 5 from a top surface 5*b* to a bottom surface 5*a* of the elastic member 5. The diameter of the hole 51 is formed to be larger than the diameter of any of a later-described lower-side shaft 45, a plate-like member 44 and the third shaft 48 of the sliding shaft member 4, and does not inhibit the movement of the sliding shaft member 4 when the sliding shaft member 4 moves up and down.

FIG. 52 is a front view illustrating a sliding shaft member of the Third Example of the counterplate positioning jig of the second embodiment.

The sliding shaft member 4 is a member for precisely determining the position of the counterplate 270 and the cutting plate 240. After the counterplate 270 has been mounted on the sliding shaft member 4, the cutting die 205 is allowed to approach the cutting plate 240, bringing the counterplate 270 into contact with the cutting plate 240 and precisely attaching the counterplate 270 on the cutting plate 240.

The sliding shaft member 4 has a generally cylindrical shape, including, going from bottom to top, the third shaft 48 for mounting the counterplate 270, a plate-like member 44, a lower-side shaft 45, a lower-side inclined portion 42, a middle inclined portion 43, and a second shaft 47, all of which are integrally formed. The third shaft 48, the plate-like member 44, and the lower-side shaft 45 form the protruding portion 4*a* of the sliding shaft member 4. The height of the protruding portion 4*a* is set to be greater than that of the elastic member 5. When the sliding shaft member 4 is in the state of being pulled downward to the lower limit position (FIG. 43 and FIG. 47), the third shaft 48 is exposed at the bottom surface 5*a* via the hole 51 in the elastic member 5. By mounting the third shaft 48 into the holes 277 in the counterplate 270, the counterplate 270 can be mounted on the sliding shaft member 4.

The sliding shaft member 4 comprises, for example, a single or composite resin material, a hard plastic, a hard metal, or a compound material that is a combination of these.

The sliding shaft member 4 has the plate-like member 44, which has a larger diameter than the lower-side shaft 45 and the third shaft 48, arranged between the lower-side shaft 45 and the third shaft 48. Thus, when the sliding shaft member 4 moves upwards, a top surface 44*b* of the plate-like member 44 makes contact with the lower surface 2*a* of the housing 2 and the movement stops.

Moreover, when the cutting die 205 is turned over to remove the counterplate positioning jigs 1 from the cutting die 205, the lower surface 2*a* of the housing 2 makes contact with the upper surface 44*b* of the plate-like member 44, thereby preventing the sliding shaft member 4 from dropping out.

The lower-side inclined portion 42 of the sliding shaft member 4 has the same direction of inclination as, and a different angle of inclination to, the hole-side inclined portion 21 of the housing 2 (sufficiently different to allow a gap to form) (FIG. 47). The middle inclined portion 43 of the sliding shaft member 4 is inclined in the opposite direction to the hole-side inclined portion 21 of the housing 2. In short, the middle inclined portion 43 and the lower-side inclined portion 42 are inclined in opposite directions.

Next, a method of using the positioning jig 1 of the present example will be described. FIG. 49 is a cross-sectional view schematically illustrating the relationship between the cutting die and the cutting plate when the Third Example of the counterplate positioning jig of the second embodiment is mounted on the cutting die of the blanking machine. This drawing shows a state in which the counterplate has been mounted on the lower ends of the sliding shaft members of the positioning jigs. FIG. 50 is a cross-sectional view schematically illustrating the relationship between the cutting die and the cutting plate when the Third Example of the counterplate positioning jig of the second embodiment is mounted on the cutting die of the blanking machine. This drawing shows a state in which the counterplate is being mounted on the cutting plate. FIG. 51 is a cross-sectional view schematically illustrating the relationship between the cutting die and the cutting plate when the counterplate positioning jig of the Third Example of the second embodiment is mounted on the cutting die of the blanking machine. This drawing shows a state after the counterplate has been mounted on the cutting plate.

The positioning jigs 1 are installed in mounting holes 290, which are formed at a plurality of locations in the cutting die 205, and the sliding shaft members 4 are pulled to the lower limit positions from the housings 2. When a sliding shaft member 4 is pulled to the lower limit position, the middle inclined portion 43 of the sliding shaft member 4 and the lower-side protrusion 31 of the engaging means 3 make contact, putting the sliding shaft member 4 in a state of engagement within the housing 2 at the lower limit position. Moreover, the tip 48 (third shaft) of the sliding shaft member 4 is exposed at the bottom surface 5*a* elastic member 5 (FIG. 47). At the lower limit position, the tip 48 (third shaft) of the sliding shaft member 4 is positioned lower than the leading edges 260*a* of the cutting blade 260.

Next, the tips 48 (third shafts) of the sliding shaft members 4 are mounted into the holes 277 in the counterplate 270, thereby mounting the counterplate 270 on the sliding shaft members 4 (FIG. 49).

Then, the cutting die 205 is brought close to the cutting plate 240 to bring the counterplate 270 and the cutting plate 240 into contact. At this time, the elastic member 5 between the housing 2 and the counterplate 270 is sandwiched between the cutting die 205 and the counterplate 270 and, subject to external forces on the top surface 5*b* and the bottom surface 5*a*, the elastic member 5 enters a vertically compressed state (FIG. 50). Due to the contact between the cutting die 205 and the cutting plate 240, the sliding shaft member 4 slides against the engaging force from the engaging means 3 and is pressed into the elastic member 5 and the housing 2. The top surface 44*b* of the plate-like member 44 of the sliding shaft member 4 then makes contact with the bottom surface 2*a* of the housing 2, bringing the sliding motion of the sliding shaft member 4 to a stop at the upper limit position (FIG. 48). When the sliding shaft member 4 is pushed into the upper limit position, the lower-side protrusion 31 of the engaging means 3 is in contact with the lower-side inclined portion 42 of the sliding shaft member 4, and the sliding shaft member 4 is in a state of engagement in the housing 2 at the upper limit position.

Thereafter, the cutting die 205 and the cutting plate 240 move in separate directions. At this time, the force (elastic force) attempting to return the elastic member 5 to its original dimensions acts on the counterplate 270, thereby enabling the tips 48 (third shafts) of the sliding shaft members 4 to release cleanly from the holes 277 in the counterplate 270, ensuring that the counterplate 270 mounts in a precise position on the cutting plate 240 (FIG. 51).

After the counterplate 270 has been positioned and mounted on the cutting plate 240, the cutting die 205 is turned over and the positioning jigs 1 are removed.

Thus, with the elastic member 5 being provided to the bottom surface 2*a* of the housing 2, when mounting the counterplate 270 on the cutting plate 240 an elastic force from the elastic member 5 makes it possible to cleanly release the tips 48 (third shafts) of the sliding shaft members 4 from the holes 277 in the counterplate 270, which makes it possible to mount the counterplate 270 in a precise position on the cutting plate 240.

Moreover, when the cutting die 205 is turned over to remove the counterplate positioning jigs 1, the bottom surface 2*a* of the housing 2 makes contact with the top surface 44*b* of the plate-like member 44 of the sliding shaft member 4, thereby preventing the sliding shaft member 4 from dropping out.

Also, since it is possible to integrally form the housing 2 and the elastic member 5, the positioning jig can be manufactured easily and inexpensively.

Fourth Example

FIG. 55 is a cross-sectional view of a Fourth Example of the counterplate positioning jig of the second embodiment, illustrating a state in which the sliding shaft member has been pulled down to the lower limit position. FIG. 56 is a perspective view illustrating the elastic member of the Fourth Example of the counterplate positioning jig of the second embodiment. FIG. 57 is a plan view illustrating the elastic member of the Fourth Example of the counterplate positioning jig of the second embodiment. FIG. 58 is a cross-sectional view of the Fourth Example of the counterplate positioning jig of the second embodiment, illustrating a state in which the sliding shaft member has been pushed upwards to the upper limit position.

The counterplate positioning jig of the Fourth Example of the second embodiment uses an elastic member of a different form to the one used in the Third Example, but is otherwise identical in configuration to the Third Example. Redundant descriptions of configurations identical to those of the Third Example have therefore been omitted.

The elastic member 5 is configured from an upper cylindrical portion 52, a lower cylindrical portion 53, and a plurality of band-like members 54.

The upper cylindrical portion 52 is cylindrical, is provided with a central hole 52*c*, and is formed so that, when the sliding shaft member 4 has been pulled downward (lower limit position), the lower surface 44*a* of the plate-like member 44 of the sliding shaft member 4 contacts the lower end surface 52*a* of the upper cylindrical portion 52. The hole 52*c* of the upper cylindrical portion 52 is formed to be larger than the tip 48 (third shaft) of the sliding shaft member 4 but smaller than the plate-like member 44, and the tip 48 of the sliding shaft member 4 passes through the hole 52*c* of the upper cylindrical portion 52, so as to be exposed at the upper end surface 52*b* of the upper cylindrical portion 52. The tip 48 of the sliding shaft member 4 protrudes from the upper end surface 52*b* of the upper cylindrical portion 52 by an amount sufficient to appropriately mount in the hole of 277 of the counterplate 270 (FIG. 55).

The ends of the plurality of band-like members 54 are mounted, equally spaced, around the periphery of the upper cylindrical portion 52 (FIG. 57).

The lower cylindrical portion 53 is cylindrical, and is provided with a central hole 53*c*. A lower end surface 53*a* of the lower cylindrical portion 53 is joined to the bottom surface 2*a* of the housing 2. The hole 53*c* of the lower cylindrical portion 53 is formed to be larger than the lower-side shaft 45, the plate-like member 44, and the tip 48 (third shaft) of the sliding shaft member 4. When the sliding shaft member 4 is in the pulled down state (lower limit position), the lower-side shaft 45, the plate-like member 44, and the tip 48 pass through the hole 53*c* of the lower cylindrical portion 53 and are exposed at the upper end surface 53*b* of the lower cylindrical portion 53. When the sliding shaft member 4 is in a state of being pushed up (upper limit position), the bottom surface 44*a* of the plate-like member 44 of the sliding shaft member 4 separates from the lower end surface 52*a* of the upper cylindrical portion 52, and the top surface 44*b* of the plate-like member 44 is in contact with the bottom surface 2*a* of the housing 2 (FIG. 58).

The other ends of the plurality of band-like members 54 are mounted, equally spaced, around the periphery of the lower cylindrical portion 53 (FIG. 57).

The plurality of band-like members 54 have an extended rectangular form, with one end mounted on the upper cylindrical portion 52 and the other mounted on the lower cylindrical portion 53, thus forming a bridge between the upper cylindrical portion 52 and the lower cylindrical portion 53. Although four band-like members 54 are used in the Fourth Example, the number can be two, six, or some other number selected as appropriate.

The elastic member 5 has elastic properties, and the housing 2 and the elastic member 5 are integrally formed.

Next, a method of using the positioning jig 1 of the present example will be described.

The positioning jigs 1 are installed in mounting holes 290, which are formed at a plurality of locations in the cutting die 205, and the sliding shaft members 4 are pulled to the lower limit position from the housings 2. When a sliding shaft members 4 has been pulled to the lower limit position, the bottom surface 44*a* of the plate-like member 44 of the sliding shaft member 4 is in contact with the lower end surface 52*a* of the upper cylindrical portion 52 of the elastic member 5 (FIG. 55).

Then, the cutting die 205 is brought close to the cutting plate 240 to bring the counterplate 270 and the cutting plate 240 into contact. At this time, the elastic member 5 between the housing 2 and the counterplate 270 is sandwiched between the cutting die 205 and the counterplate 270 and, subject to external forces on the upper end surface 52*b* of the upper cylindrical portion 52 and on the lower end surface 53*a* of the lower cylindrical portion 53, the elastic member 5 enters a vertically compressed state with the plurality of band-like members 54 in a deflected state. Due to the contact between the cutting die 205 and the cutting plate 240, the sliding shaft member 4 slides against the engaging force from the engaging means 3 and is pressed into the elastic member 5 and the housing 2. The top surface 44*b* of the plate-like member 44 of the sliding shaft member 4 then makes contact with the bottom surface 2*a* of the housing 2, bringing the sliding motion of the sliding shaft member 4 to a stop at the upper limit position (FIG. 58).

Thereafter, the cutting die 205 and the cutting plate 240 move in the separation direction. At this time, the force (elastic force) attempting to return the plurality of band-like members 54 to their original dimensions acts on the counterplate 270, thereby enabling the tips 48 (third shafts) of the sliding shaft members 4 to release cleanly from the holes 277 in the counterplate 270, ensuring that the counterplate 270 mounts in a precise position on the cutting plate 240.

Thus, by configuring an elastic member 5 from an upper cylindrical portion 52, a lower cylindrical portion 53, and a plurality of band-like members 54, it is possible to achieve a clean release of the tips 48 (third shafts) of sliding shaft members 4 from holes 277 of the counterplate 270, using a smaller amount of material.

Fifth Example

FIG. 59 is a front view illustrating a Fifth Example of the counterplate positioning jig of the second embodiment. FIG. 60 is a cross-sectional view of a Fifth Example of the counterplate positioning jig of the second embodiment, illustrating the state in which the sliding shaft member has been pulled down to the lower limit position. FIG. 61 is a front view illustrating an elastic member of the Fifth Example of the counterplate positioning jig of the second embodiment. FIG. 62 is right side view of the Fifth Example of the counterplate positioning jig of the second embodiment, illustrating a state in which the sliding shaft member has been pushed upwards to the upper limit position.

The counterplate positioning jig of the Fifth Example of the second embodiment uses an elastic member of a different form to the ones used in the Third and Fourth Examples, but is otherwise identical in configuration to the Third Example. Redundant descriptions of configurations identical to those of the Third Example have therefore been omitted.

The elastic member 5 is configured from an upper cylindrical portion 55 and a pair of leg members 56, 56.

The upper cylindrical portion 55 is cylindrical, is provided with a central hole 55*c*, and is formed so that, when the sliding shaft member 4 is in the pulled downward state (lower limit position), the bottom surface 44*a* of the plate-like member 44 of the sliding shaft member 4 contacts the lower end surface 55*a* of the upper cylindrical portion 55. The hole 55*c* of the upper cylindrical portion 55 is formed to be larger than the tip 48 (third shaft) of the sliding shaft member 4 but smaller than the plate-like member 44, and the tip 48 of the sliding shaft member 4 passes through the hole 55*c* of the upper cylindrical portion 55, so as to be exposed at the upper end surface 55*b* of the upper cylindrical portion 55. The tip 48 of the sliding shaft member 4 protrudes from the upper end surface 55*b* of the upper cylindrical portion 55 by an amount sufficient to appropriately mount in the hole 277 of the counterplate 270 (FIG. 59).

One end of the pair of leg members 56, 56 is mounted on the periphery of the upper cylindrical portion 55 (FIG. 59).

The pair of leg members 56, 56 are, when viewed from the side, rectangular with two concave sides that arc towards a central portion (FIG. 59). When viewed from the front, the pair describe a gentle arc from the upper cylindrical portion 55 and are joined to the bottom surface 2*a* of the housing 2 (FIG. 60 and FIG. 61).

The elastic member 5 has elastic properties, and the housing 2 and the elastic member 5 are integrally formed.

Next, a method of using the positioning jig 1 of the present example will be described. The positioning jigs 1 are installed in mounting holes 290, which are formed at a plurality of locations in a cutting die 205, and sliding shaft members 4 are pulled to a lower limit position from the housings 2. When a sliding shaft member 4 has been pulled to the lower limit position, the bottom surface 44*a* of the plate-like member 44 of the sliding shaft member 4 is in contact with the lower end surface 55*a* of the upper cylindrical portion 55 of the elastic member 5 (FIG. 60).

Then, the cutting die 205 is brought close to the cutting plate 240 to bring the counterplate 270 and the cutting plate 240 into contact. At this time, the elastic member 5 between the housing 2 and the counterplate 270 is sandwiched between the cutting die 205 and the counterplate 270 and, subject to external forces on the upper end surface 55*b* of the upper cylindrical portion 55 and joint surface between the pair of leg members 56, 56 and the housing 2, the elastic member 5 enters a vertically compressed state with the pair of leg members 56, 56 in a deflected state. Due to the contact between the cutting die 205 and the cutting plate 240, the sliding shaft member 4 slides against the engaging force from the engaging means 3 and is pressed into the elastic member 5 and the housing 2. The top surface 44*b* of the plate-like member 44 of the sliding shaft member 4 then makes contact with the bottom surface 2*a* of the housing 2, bringing the sliding motion of the sliding shaft member 4 to a stop at the upper limit position (FIG. 62).

Thereafter, the cutting die 205 and the cutting plate 240 move in the separation direction. At this time, the force (elastic force) attempting to return the elastic member 5 to its original dimensions acts on the counterplate 270, thereby enabling the tips 48 (third shafts) of the sliding shaft members 4 to release cleanly from the holes 277 in the counterplate 270, ensuring that the counterplate 270 mounts in a precise position on the cutting plate 240.

Thus, by configuring the elastic member 5 from the upper cylindrical portion 55 and the pair of leg members 56, 56, it is possible to achieve a clean release of the tips 48 (third shafts) of the sliding shaft members 4 from the holes 277 of the counterplate 270, using a smaller amount of material.

Sixth Example

FIG. 63 is a right side view illustrating a Sixth Example of the counterplate positioning jig of the second embodiment. FIG. 64 is a cross-sectional view of a Sixth Example of the counterplate positioning jig of the second embodiment, illustrating a state in which the sliding shaft member has been pulled down to the lower limit position. FIG. 65 is a cross-sectional view of the Sixth Example of the counterplate positioning jig of the second embodiment, illustrating a state in which the sliding shaft member has been pushed upwards to the upper limit position.

Whereas in the counterplate positioning jigs of the Third, Fourth and Fifth Examples of the second embodiment the elastic member was integrally formed with the housing, the elastic member of the Sixth Example is not formed integrally with the housing, but is provided as a separate member. Careful attention has been paid to the form of the elastic member to prevent release of the elastic member from the bottom surface of the housing. Since the Sixth Example is otherwise identical in configuration to the Third Example, redundant descriptions of configurations identical to those of the Third Example have therefore been omitted.

The counterplate positioning jig 1 of the present embodiment is configured from a cylindrical housing 2, a sliding shaft member 4 installed in the housing 2, an engaging means 3 that alternates between a lower-side lock and an upper-side lock with respect to the sliding shaft member 4 within the housing 2, and a cylindrical elastic member 5 disposed to the bottom surface 2*a* of the housing 2 (FIGS. 63 to 65). The housing 2, the sliding shaft member 4, and the elastic member 5 have rotational symmetry about the line P1-P1 (FIG. 64 and FIG. 65).

FIG. 66 is a perspective view illustrating the elastic member of the Sixth Example of the counterplate positioning jig of the second embodiment. FIG. 67 is a cross-sectional view illustrating the elastic member of the Sixth Example of the counterplate positioning jig of the second embodiment.

The elastic member 5 is provided at the bottom surface 2*a* of the housing 2 (FIG. 64 and FIG. 65), but the top surface 5*b* of the elastic member 5 and the bottom surface 2*a* of the housing 2 are not adhered by an adhesive agent or the like, and are formed as separate members. The elastic member 5 is formed of a material with elastic properties, such as urethane foam or rubber sponge.

The elastic member 5 is cylindrical and is provided with columnar holes 58*b* (first hole), 57 (second hole), and 58*a* (third hole) that centrally pierce the elastic member 5 from the top surface 5*b* to the bottom surface 5*a* of the elastic member 5. Starting at the top surface 5*b*, the holes are provided in the order of first hole 58*b*, second hole 57, and third hole 58*a*, piercing the elastic member 5 from the top surface 5*b* to the bottom surface 5*a*. Here, the first hole 58*b* and the third hold 58*a* are formed by donut-like projecting portions 58*ba* and 58*aa*, which project from the second hole 57 provided in the elastic member 5 (FIG. 67).

The diameters of the first hole 58*b* and the third hole 58*a* are formed to be equal to or slightly larger than the diameter of the lower-side shaft 45 of the sliding shaft member 4, and smaller than the diameter of the plate-like member 44.

The diameter of the second hole 57 is formed to be larger than the diameter of any of the lower-side shaft 45, the plate-like member 44, and the third shaft 48 of the sliding shaft member 4, and does not inhibit the movement of the sliding shaft member 4 when the sliding shaft member 4 moves up and down.

Next, a method of using the positioning jig 1 of the present example will be described.

The positioning jigs 1 are installed in the mounting holes 290, which are formed at a plurality of locations in the cutting die 205, and the sliding shaft members 4 are pulled to the lower limit position from the housings 2.

When the sliding shaft member 4 is passed through the holes 58*b* (first hole), 57 (second hole), and 58*a* (third hole) of the elastic member 5, the plate-like member 44 of the sliding shaft member 4 hits the projecting portions 58*ba* and

58*aa* of the elastic member 5, but, due to the elastic properties of the elastic member 5, the first hole 58*b* and the third hole 58*a* are widened, and the tip 48 (third shaft) of the sliding shaft member 4 and the plate-like member 44 are exposed at the bottom surface 5*a* of the elastic member 5 (FIG. 64).

When the sliding shaft member 4 is pulled to the lower limit position, the elastic member 5 (projecting portions 58*ba* and 58*aa*) is held between the bottom surface 2*a* of the housing 2 and the top surface 44*b* of the plate-like member 44, and the elastic member 5 will not come off of the positioning jig 1.

Next, the tips 48 (third shafts) of the sliding shaft members 4 are mounted in the holes 277 in the counterplate 270, mounting the counterplate 270 on the sliding shaft members 4.

Then, the cutting die 205 is brought close to the cutting plate 240 to bring the counterplate 270 and the cutting plate 240 into contact. At this time, the elastic member 5 between the housing 2 and the counterplate 270 is sandwiched between the cutting die 205 and the counterplate 270 and, subject to external forces on the top surface 5*b* and the bottom surface 5*a*, enters a vertically compressed state. Due to the contact between the cutting die 205 and the cutting plate 240, the sliding shaft member 4 slides against the engaging force from the engaging means 3, widens the third hole 58*a* of the elastic member 5, and is pressed into the elastic member 5 and the housing 2. The top surface 44*b* of the plate-like member 44 of the sliding shaft member 4 then makes contact with a top surface 57*b* of the second hole 57 of the elastic member 5, bringing the sliding motion of the sliding shaft member 4 to a stop at the upper limit position. Since the top surface 44*b* of the plate-like member 44 of the sliding shaft member 4 is in contact with the top surface 57*b* of the second hole 57 of the elastic member 5, when the sliding shaft member 4 is at the upper limit position, the projecting portion 58*ba* of the elastic member 5 is held between the bottom surface 2*a* of the housing 2 and the top surface 44*b* of the plate-like member 44, and the elastic member 5 will not come off of the positioning jig 1.

Thereafter, the cutting die 205 and the cutting plate 240 move in the separation direction. At this time, the force (elastic force) attempting to return the elastic member 5 to its original dimensions acts on the counterplate 270, thereby enabling the tips 48 (third shafts) of the sliding shaft members 4 to release cleanly from the holes 277 in the counterplate 270, ensuring that the counterplate 270 mounts in a precise position on the cutting plate 240.

Thus, with the elastic member 5 being provided to the bottom surface 2*a* of the housing 2, when the counterplate 270 is being mounted on the cutting plate 240, an elastic force from the elastic member 5 makes it possible to cleanly release the tips 48 (third shafts) of the sliding shaft members 4 from the holes 277 in the counterplate 270, which makes it possible to mount the counterplate 270 in a precise position on the cutting plate 240.

Moreover, when the sliding shaft member 4 is pulled to the lower limit position, the elastic member 5 (projecting portions 58*ba* and 58*aa*) are sandwiched between the bottom surface 2*a* of the housing 2 and the top surface 44*b* of the plate-like member 44 and cannot therefore separate from the positioning jig 1. When the sliding shaft member 4 is in the upper limit position, the elastic member 5 (projecting portion 58*ba*) is sandwiched between the bottom surface 2*a* of the housing 2 and the top surface 44*b* of the plate-like member 44, and cannot therefore come off of the positioning jig 1. Therefore, even when formed as a separate member and not integrally formed with the housing, the elastic member 5 will not separate from the bottom surface of the housing.

In the embodiments above, an arrangement was described in which tapered forms where used as the locking means. However, the present invention is not limited to this arrangement. The locking means can, for example, be configured by providing an engaging means in another form that is compatible with the sliding shaft member and the accommodation hole 29 of the housing. Similarly, the forms of the hole-side inclined portion 21, the lower-side inclined portion 42, and other portions are not limited to the described arrangements. In addition, the present embodiments are not restricted to the processing of sheet members for assembling paper articles, but naturally can also be applied to sheet members for assembling cardboard and other thick papers.

DESCRIPTION OF THE SYMBOLS

1 Counterplate positioning jig,
2 Housing,
21 Hole-side inclined portion,
29 Hole,
3 Engaging means,
4 Sliding shaft member,
42 Lower-side inclined portion (lower-side lock position),
43 Middle inclined portion (upper-side lock position),
45 Lower-side shaft (protruding portion)
5 Elastic member,
205 Cutting die,
240 Cutting plate,
270 Counterplate,
290 Mounting hole,
300 Positioning-use marking member

The invention claimed is:

1. A counterplate positioning jig mounted on a sheet blanking machine including a cutting die equipped with a cutting blade and a cutting plate that faces the cutting blade to receive the cutting blade when the cutting blade moves downward, the counterplate positioning jig being mounted to be directed downward in each of a plurality of mounting holes in the cutting die, for mounting a counterplate on the cutting plate, comprising:

a sliding shaft member for determining a position on an upper surface of the cutting plate;

a housing having an accommodation hole that houses the sliding shaft member; and an elastic member including a hole in which a tip end of the sliding shaft member is interposed, and arranged at a bottom end of the housing, the elastic member having an elastic force to release the tip end of the sliding shaft member from a hole of the counterplate in which the tip end of the sliding shaft member is inserted, wherein the counterplate positioning jig has a structure in which the sliding shaft member moves up and down within the housing and is held at a fixed position within the housing such that the sliding shaft member does not drop out from the housing, and the elastic force of the elastic member acts on the sliding shaft to release the tip end of the sliding shaft from the counterplate when the cutting die and the cutting plate are separated from each other.

2. The counterplate positioning jig of claim 1, wherein the elastic member is integrally formed with the housing.

3. The counterplate positioning jig of claim 1, wherein the elastic member includes a protruding portion protruding from an inside surface of the elastic member into the accommodation hole, and the elastic member is engaged by the protruding portion being held between the sliding shaft member and the housing.

4. The counterplate positioning jig of claim 1, wherein the elastic member is arranged under the housing in an axial direction of the sliding shaft, and encloses the tip end of the sliding shaft member in a circumferential direction of the sliding shaft.

5. A counterplate positioning jig mounted on a sheet blanking machine including a cutting die equipped with a cutting blade and a cutting plate that faces the cutting blade to receive the cutting blade when the cutting blade moves downward, the counterplate positioning jig being mounted to be directed downward in each of a plurality of mounting holes in the cutting die, for mounting a counterplate on the cutting plate, comprising:

a sliding shaft member for determining a position on an upper surface of the cutting plate;

a housing having an accommodation hole that houses the sliding shaft member;

an engaging member having a form corresponding to the sliding shaft member and the accommodation hole of the housing; and an elastic member including a hole in which a tip end of the sliding shaft member is interposed, and arranged at a bottom end of the housing, the elastic member having an elastic force to release the tip end of the sliding shaft member from a hole of the counterplate in which the tip end of the sliding shaft member is inserted, wherein the counterplate positioning jig has a structure in which, when the sliding shaft member is pulled downward, the sliding shaft member is engaged to the engaging member such that the sliding shaft member is prevented via the engaging member from dropping out, and the elastic force of the elastic member acts on the sliding shaft to release the tip end of the sliding shaft from the counterplate when the cutting die and the cutting plate are separated from each other.

6. The counterplate positioning jig of claim 5, wherein the tip end of the sliding shaft member is released from the hole of the counterplate by the elastic force of the elastic member when the cutting die and the cutting plate are separated from each other.

7. The counterplate positioning jig of claim 6, wherein the elastic member is integrally formed with the housing.

8. The counterplate positioning jig of claim 6, wherein the elastic member includes a protruding portion protruding from an inside surface of the elastic member into the accommodation hole, and the elastic member is engaged by the protruding portion being held between the sliding shaft member and the housing.

9. The counterplate positioning jig of claim 5, wherein the elastic member is arranged under the housing in an axial direction of the sliding shaft, and encloses the tip end of the sliding shaft member in a circumferential direction of the sliding shaft, and the housing further includes a window portion in which the engaging member is arranged, and the engaging member further includes a protrusion protruding into the accommodation hole to engage with the sliding shaft member.

10. A counterplate positioning jig mounted on a sheet blanking machine including a cutting die equipped with a cutting blade and a cutting plate that faces the cutting blade to receive the cutting blade when the cutting blade moves downward, the counterplate positioning jig being mounted to be directed downward in each of a plurality of mounting holes in the cutting die, for mounting a counterplate on the cutting plate, comprising:

a sliding shaft member for determining a position on an upper surface of the cutting plate, including a lower-side inclined portion;

a housing, in which the sliding shaft is installed, having an accommodation hole housing the sliding shaft member, and a hole-side inclined portion formed in the accommodation hole and inclined toward a lower side thereof, the lower-side inclined portion being inclined in a direction same as the hole-side inclined portion;

an engaging member including a projection formed at a lower portion thereof and integrally formed with the housing, the engaging member engaging with the sliding shaft member; and an elastic member including a hole in which a tip end of the sliding shaft member is interposed, and arranged at a bottom end of the housing, the elastic member having an elastic force to release the tip end of the sliding shaft member from a hole of the counterplate in which the tip end of the sliding shaft member is inserted, wherein a locking structure is provided to lock the sliding shaft member through an engagement of the hole-side inclined portion and the lower-side inclined portion and an engagement of the engaging member and the lower-side inclined portion, and when the sliding shaft member is pulled downward, the hole-side inclined portion and the lower-side inclined portion are engaged each other and the sliding shaft member is locked at a lower side of the housing, and when the sliding shaft member is pushed upward, a lock of the sliding shaft at the lower-side of the housing is released, and the sliding shaft member moves upward to engage the engaging member and the lower-side inclined portion and the sliding shaft is locked at an upper side of the housing.

11. The counterplate positioning jig of claim 10, wherein the lower-side inclined portion is formed as a taper having an incline that is inclined in the direction same as and at an angle different from, the hole-side inclined portion.

12. The counterplate positioning jig of claim 10, wherein the hole-side inclined portion has, in the accommodation hole, an inner diameter at an upper side larger than the inner diameter at a lower side thereof;

the engaging member is arranged to be above the hole-side inclined portion;

the sliding shaft further includes a protruding part protruding downward from the housing, and a middle inclined portion disposed above the lower-side inclined portion and having an inclination in a direction opposite to the hole-side inclined portion, the middle inclined portion and the lower-side inclined portion being integrally formed;

the lower-side inclined portion is disposed above the protruding part and is inclined at an angle different from the hole-side inclined portion; and the sliding shaft member stops at a lower limit position and is locked at the lower side of the housing, when the sliding shaft member is pulled downward, and the sliding shaft member stops at an upper limit position and is locked at the upper side of the housing when the sliding shaft member is pushed upward.

13. The counterplate positioning jig of claim 10, wherein the engaging member includes an elastic body integrally formed with the housing, and the sliding shaft member is engaged using a biasing force from the elastic body.

14. The counterplate positioning jig of claim 10, wherein the engaging member is a C-type concentric snap ring using a biasing force from a leaf spring, ball plunger, or a spring.

15. The counterplate positioning jig of claim 10, the tip end of the sliding shaft member is released from the hole of the counterplate by the elastic force of the elastic member when the cutting die and the cutting plate are separated from each other.

16. The counterplate positioning jig of claim 15, wherein the elastic member is integrally formed with the housing.

17. The counterplate positioning jig of claim 15, wherein the elastic member includes a protruding portion protruding from an inside surface of the elastic member into the accommodation hole, and the elastic member is engaged by the protruding portion being held between the sliding shaft member and the housing.

18. The counterplate positioning jig of claim 10, wherein the sliding shaft member includes:

a plate member formed at a lower portion of the sliding shaft member and having a diameter larger than that of a lower end of the accommodation hole of the housing, a protruding shaft protruding downward from the plate member, a lower-side shaft extending upward from the plate member, the lower-side inclined portion being connected to an upper end of the lower-side shaft, a middle inclined portion connected to an upper end of the lower-side inclined portion, and having an inclination in a direction opposite to the lower-side inclined portion, and an upper-side shaft extending upward from the middle inclined portion; and the engaging member engages with the middle inclined portion to lock the sliding shaft member at the lower side of the housing when the sliding shaft member is pulled downward.

19. The counterplate positioning jig of claim 10, wherein the elastic member is arranged under the housing in an axial direction of the sliding shaft, and encloses the tip end of the sliding shaft member in a circumferential direction of the sliding shaft, and the engaging member is arranged above the hole-side inclined portion in an axial direction of the sliding shaft.

* * * * *